US008889205B2

(12) United States Patent
Sierra-Gomez et al.

(10) Patent No.: US 8,889,205 B2
(45) Date of Patent: Nov. 18, 2014

(54) RESEALABLE CLOSURE WITH PACKAGE INTEGRITY FEATURE

(75) Inventors: Gladys Odette Sierra-Gomez, Woodbridge, NJ (US); Ron Exner, Icking (DE); Olav Dagestad, Oslo (NO); Alexis Julian Gracia-Lugo, Bloomingdale, NJ (US)

(73) Assignee: Intercontinental Great Brands LLC, East Hanover, NJ (US)

( * ) Notice: Subject to any disclaimer, the term of this patent is extended or adjusted under 35 U.S.C. 154(b) by 0 days.

(21) Appl. No.: 13/348,536

(22) Filed: Jan. 11, 2012

(65) Prior Publication Data

US 2012/0125932 A1 May 24, 2012

Related U.S. Application Data

(63) Continuation of application No. 11/616,386, filed on Dec. 27, 2006, now Pat. No. 8,114,451.

(51) Int. Cl.
*A22C 13/00* (2006.01)
*B65D 75/58* (2006.01)

(52) U.S. Cl.
CPC .... *B65D 75/5838* (2013.01); *B65D 2101/0092* (2013.01); *B65D 2101/0084* (2013.01); *Y10S 206/807* (2013.01)
USPC ..... 426/87; 426/115; 220/255.1; 220/359.1; 220/255; 206/557; 383/203; 383/66; 383/211; 206/807

(58) Field of Classification Search
CPC ..... B65D 75/5838; B65D 2101/0092; B65D 2101/0084; B65D 75/5855; B65D 75/5833
USPC ..... 383/5, 203, 66, 211; 426/87, 115; 220/255.1, 359.1, 255; 206/557
See application file for complete search history.

(56) References Cited

U.S. PATENT DOCUMENTS 811,092 A 1/1906 Roberts
1,065,012 A 6/1913 Watanabe
(Continued)

FOREIGN PATENT DOCUMENTS

AU 2002334419 5/2003
AU 768679 12/2003
(Continued)

OTHER PUBLICATIONS

English Translation of JP H09-156677, published Jun. 17, 1995.
(Continued)

*Primary Examiner* — Rena L Dye
*Assistant Examiner* — Chaim Smith
(74) *Attorney, Agent, or Firm* — Fitch, Even, Tabin & Flannery LLP

(57) ABSTRACT

A resealable package integrity closure includes a film layer forming a top of a container and a flap defining an access opening. A sealing panel completely covers the flap of the film layer. A releasable adhesive is provided on either or both the film layer and the sealing panel for adhering the sealing panel to the film layer. The sealing panel is releasable from the film layer by pulling the sealing panel back in a peeling direction and reclosable against the top to seal the access opening when the sealing panel is moved back against the top. A coating of transferable material is provided on either the sealing panel or on the film layer, which is transferable therebetween to provide a visual indication that the closure has been previously opened.

20 Claims, 14 Drawing Sheets

(56) References Cited

U.S. PATENT DOCUMENTS

| | | | |
|---|---|---|---|
| 1,106,721 | A | 8/1914 | Lewis |
| 1,171,462 | A | 2/1916 | Rice |
| 1,791,352 | A | 2/1931 | Colonnese |
| 1,949,161 | A | 6/1932 | Haug |
| 1,963,639 | A | 6/1934 | Ahlquist |
| 1,978,035 | A | 10/1934 | Thorn |
| 2,066,495 | A | 1/1937 | Swift |
| 2,128,196 | A | 8/1938 | Vogel |
| 2,475,236 | A | 7/1947 | Gollab |
| 2,621,788 | A | 10/1948 | Hitchcock |
| 2,554,160 | A | 5/1951 | Von Gunten |
| 2,605,897 | A | 8/1952 | Rundle |
| 2,684,807 | A | 7/1954 | Gerrish |
| 2,965,224 | A | 12/1960 | Hardwood |
| 3,080,238 | A | 3/1963 | Kraft et al. |
| 3,127,273 | A | 3/1964 | Monoham |
| 3,179,326 | A | 4/1965 | Underwood et al. |
| 3,186,628 | A | 6/1965 | Rohde |
| 3,187,982 | A | 6/1965 | Underwood et al. |
| 3,217,871 | A | 11/1965 | Lee |
| 3,235,165 | A | 2/1966 | Jackson |
| 3,245,525 | A | 4/1966 | Shoemaker |
| 3,259,303 | A | 7/1966 | Repko |
| 3,260,358 | A | 7/1966 | Gottily et al. |
| 3,272,422 | A | 9/1966 | Miller |
| 3,311,032 | A | 3/1967 | Lucas |
| 3,326,450 | A | 6/1967 | Langdon |
| 3,331,501 | A | 7/1967 | Stewart, Jr. |
| 3,343,541 | A | 9/1967 | Bellamy, Jr. |
| 3,373,926 | A | 3/1968 | Voigtman et al. |
| 3,454,210 | A | 7/1969 | Spiegel et al. |
| 3,520,401 | A | 7/1970 | Richter |
| 3,528,825 | A | 9/1970 | Doughty |
| 3,570,751 | A | 3/1971 | Trewella |
| 3,595,466 | A | 7/1971 | Rosenburg, Jr. |
| 3,595,468 | A | 7/1971 | Repko |
| 3,618,751 | A | 11/1971 | Rich |
| 3,630,346 | A | 12/1971 | Burnside |
| 3,651,615 | A | 3/1972 | Bohner et al. |
| 3,653,502 | A | 4/1972 | Beaudoin |
| 3,687,352 | A | 8/1972 | Kalajian |
| 3,740,238 | A | 6/1973 | Graham |
| 3,757,078 | A | 9/1973 | Conti et al. |
| 3,790,744 | A | 2/1974 | Bowen |
| 3,811,564 | A | 5/1974 | Braber |
| 3,865,302 | A | 2/1975 | Kane |
| 3,885,727 | A | 5/1975 | Gilley |
| 3,905,646 | A | 9/1975 | Brackmann et al. |
| 3,909,582 | A | 9/1975 | Bowen |
| 3,910,410 | A | 10/1975 | Shaw |
| 3,938,659 | A | 2/1976 | Wardwell |
| 3,966,046 | A | 6/1976 | Deutschlander |
| 3,971,506 | A | 7/1976 | Roenna |
| 3,979,050 | A | 9/1976 | Cilia |
| 4,113,104 | A | 9/1978 | Meyers |
| 4,140,046 | A | 2/1979 | Marbach |
| 4,156,493 | A | 5/1979 | Julius |
| 4,185,754 | A | 1/1980 | Julius |
| 4,192,420 | A | 3/1980 | Worrell, Sr. et al. |
| 4,192,448 | A | 3/1980 | Porth |
| 4,197,949 | A | 4/1980 | Carlsson |
| 4,258,876 | A | 3/1981 | Ljungcrantz |
| 4,260,061 | A | 4/1981 | Jacobs |
| 4,273,815 | A | 6/1981 | Gifford et al. |
| 4,285,681 | A | 8/1981 | Walitalo |
| 4,306,367 | A | 12/1981 | Otto |
| 4,337,862 | A | 7/1982 | Suter |
| 4,337,882 | A | 7/1982 | Suter |
| 4,364,478 | A | 12/1982 | Tuns |
| 4,397,415 | A | 8/1983 | Lisiecki |
| 4,411,365 | A | 10/1983 | Horikawa et al. |
| 4,420,080 | A | 12/1983 | Nakamura |
| 4,428,477 | A | 1/1984 | Cristofolo |
| 4,464,154 | A | 8/1984 | Ljungcrantz |
| 4,488,647 | A | 12/1984 | Davis |
| 4,506,488 | A | 3/1985 | Matt et al. |
| 4,518,087 | A | 5/1985 | Goglio |
| 4,538,396 | A | 9/1985 | Nakamura |
| 4,545,844 | A | 10/1985 | Buchanan |
| 4,548,824 | A | 10/1985 | Mitchell et al. |
| 4,548,852 | A | 10/1985 | Mitchell |
| 4,549,063 | A | 10/1985 | Ang et al. |
| 4,550,831 | A | 11/1985 | Whitford |
| 4,552,269 | A | 11/1985 | Chang |
| 4,557,505 | A | 12/1985 | Schaefer et al. |
| 4,570,820 | A | 2/1986 | Murphy |
| 4,572,377 | A | 2/1986 | Beckett |
| 4,608,288 | A | 8/1986 | Spindler |
| 4,610,357 | A | 9/1986 | Nakamura |
| 4,613,046 | A | 9/1986 | Kuchenbecker |
| 4,616,470 | A | 10/1986 | Nakamura |
| 4,625,495 | A | 12/1986 | Holovach |
| 4,638,911 | A | 1/1987 | Prohaska |
| 4,648,509 | A | 3/1987 | Alves |
| 4,651,874 | A | 3/1987 | Nakamura |
| 4,653,250 | A | 3/1987 | Nakamura |
| 4,658,963 | A | 4/1987 | Jud |
| 4,667,453 | A | 5/1987 | Goglio |
| 4,671,453 | A | 6/1987 | Cassidy |
| 4,673,085 | A | 6/1987 | Badouard et al. |
| 4,679,693 | A | 7/1987 | Forman |
| 4,694,960 | A | 9/1987 | Phipps et al. |
| 4,696,404 | A | 9/1987 | Corella |
| 4,723,301 | A | 2/1988 | Chang |
| 4,738,365 | A | 4/1988 | Prater |
| 4,739,879 | A | 4/1988 | Nakamura |
| 4,784,885 | A | 11/1988 | Carespodi |
| 4,790,436 | A | 12/1988 | Nakamura |
| 4,798,295 | A | 1/1989 | Rausing |
| 4,798,296 | A | 1/1989 | Lagerstedt et al. |
| 4,799,594 | A | 1/1989 | Blackman |
| 4,811,848 | A | 3/1989 | Jud |
| 4,818,120 | A | 4/1989 | Addiego |
| 4,838,429 | A | 6/1989 | Fabisiewicz et al. |
| 4,840,270 | A | 6/1989 | Caputo et al. |
| 4,845,470 | A | 7/1989 | Boldt, Jr. |
| 4,848,575 | A | 7/1989 | Nakamura et al. |
| 4,858,780 | A | 8/1989 | Odaka |
| 4,863,064 | A | 9/1989 | Dailey, III |
| 4,865,198 | A | 9/1989 | Butler |
| 4,866,911 | A | 9/1989 | Grindrod et al. |
| 4,874,096 | A | 10/1989 | Tessera-Chiesa |
| 4,876,123 | A | 10/1989 | Rivera et al. |
| 4,889,731 | A | 12/1989 | Williams, Jr. |
| 4,901,505 | A | 2/1990 | Williams, Jr. |
| 4,902,142 | A | 2/1990 | Lammert et al. |
| 4,917,247 | A | 4/1990 | Jud |
| 4,943,439 | A | 7/1990 | Andreas et al. |
| 4,972,953 | A | 11/1990 | Friedman et al. |
| 4,998,666 | A | 3/1991 | Ewan |
| 4,999,081 | A | 3/1991 | Buchanan |
| 5,000,320 | A | 3/1991 | Kuchenbecker |
| 5,001,325 | A | 3/1991 | Huizinga |
| 5,005,264 | A | 4/1991 | Breen |
| 5,010,231 | A | 4/1991 | Huizinga |
| 5,018,625 | A | 5/1991 | Focke et al. |
| 5,029,712 | A | 7/1991 | O'Brien et al. |
| 5,040,685 | A | 8/1991 | Focke et al. |
| 5,046,621 | A | 9/1991 | Bell |
| 5,048,718 | A | 9/1991 | Nakamura |
| 5,060,848 | A | 10/1991 | Ewan |
| 5,065,868 | A | 11/1991 | Cornelissen et al. |
| 5,076,439 | A | 12/1991 | Kuchenbecker |
| 5,077,064 | A | 12/1991 | Hustad et al. |
| 5,078,509 | A | 1/1992 | Center et al. |
| 5,082,702 | A | 1/1992 | Alband |
| 5,085,724 | A | 2/1992 | Focke |
| 5,096,113 | A | 3/1992 | Focke |
| 5,100,003 | A | 3/1992 | Jud |
| 5,103,980 | A | 4/1992 | Kuchenbecker |
| 5,108,669 | A | 4/1992 | vanDijk |
| 5,124,388 | A | 6/1992 | Pruett et al. |
| 5,125,211 | A | 6/1992 | O'Brien et al. |
| 5,134,001 | A | 7/1992 | Osgood |

(56) References Cited

U.S. PATENT DOCUMENTS

| | | | |
|---|---|---|---|
| 5,158,499 | A | 10/1992 | Guckenberger |
| 5,161,350 | A | 11/1992 | Nakamura |
| 5,167,974 | A | 12/1992 | Grindrod et al. |
| 5,174,659 | A | 12/1992 | Laske |
| 5,184,771 | A | 2/1993 | Jud et al. |
| 5,197,618 | A | 3/1993 | Goth |
| 5,222,422 | A | 6/1993 | Benner, Jr. et al. |
| 5,222,813 | A | 6/1993 | Kopp et al. |
| 5,229,180 | A | 7/1993 | Littmann |
| 5,294,470 | A | 3/1994 | Ewan |
| 5,307,988 | A | 5/1994 | Focke et al. |
| 5,333,735 | A | 8/1994 | Focke et al. |
| 5,344,007 | A | 9/1994 | Nakamura et al. |
| 5,352,466 | A | 10/1994 | Delonis |
| 5,356,068 | A | 10/1994 | Moreno |
| 5,366,087 | A | 11/1994 | Bane |
| 5,371,997 | A | 12/1994 | Kopp et al. |
| 5,374,179 | A | 12/1994 | Swanson |
| 5,375,698 | A | 12/1994 | Ewart et al. |
| 5,381,643 | A | 1/1995 | Kazaitis et al. |
| 5,382,190 | A | 1/1995 | Graves |
| 5,388,757 | A | 2/1995 | Lorenzen |
| 5,405,629 | A | 4/1995 | Marnocha et al. |
| 5,407,070 | A | 4/1995 | Bascos et al. |
| 5,409,115 | A | 4/1995 | Barkhorn |
| 5,409,116 | A | 4/1995 | Aronsen |
| 5,454,207 | A | 10/1995 | Storandt |
| 5,460,838 | A | 10/1995 | Wermund |
| 5,460,844 | A | 10/1995 | Gaylor |
| 5,461,845 | A | 10/1995 | Yeager |
| 5,464,092 | A | 11/1995 | Seeley |
| 5,470,015 | A | 11/1995 | Jud |
| 5,489,060 | A | 2/1996 | Godard |
| 5,499,757 | A | 3/1996 | Back |
| 5,503,858 | A | 4/1996 | Reskow |
| 5,505,305 | A | 4/1996 | Scholz et al. |
| 5,515,965 | A | 5/1996 | Boldrini et al. |
| 5,519,982 | A | 5/1996 | Herber et al. |
| 5,520,939 | A | 5/1996 | Wells |
| 5,524,759 | A | 6/1996 | Herzberg et al. |
| 5,531,325 | A | 7/1996 | Deflander et al. |
| 5,538,129 | A | 7/1996 | Chester et al. |
| 5,550,346 | A | 8/1996 | Andriash et al. |
| 5,558,438 | A | 9/1996 | Warr |
| 5,582,342 | A | 12/1996 | Jud |
| 5,582,853 | A | 12/1996 | Marnocha et al. |
| 5,582,887 | A | 12/1996 | Etheredge |
| 5,591,468 | A | 1/1997 | Stockley, III et al. |
| 5,630,308 | A | 5/1997 | Guckenberger |
| 5,633,058 | A | 5/1997 | Hoffer et al. |
| 5,637,369 | A | 6/1997 | Stewart |
| 5,647,100 | A | 7/1997 | Porchia et al. |
| 5,647,506 | A | 7/1997 | Julius |
| 5,664,677 | A | 9/1997 | O'Connor |
| 5,688,394 | A | 11/1997 | McBride, Jr. et al. |
| 5,688,463 | A | 11/1997 | Robichaud et al. |
| 5,702,743 | A | 12/1997 | Wells |
| 5,709,479 | A | 1/1998 | Bell |
| 5,725,311 | A | 3/1998 | Ponsi et al. |
| D394,605 | S | 5/1998 | Skiba et al. |
| 5,749,657 | A | 5/1998 | May |
| 5,770,283 | A | 6/1998 | Gosselin et al. |
| 5,791,465 | A | 8/1998 | Niki et al. |
| 5,795,604 | A | 8/1998 | Wells et al. |
| 5,819,931 | A | 10/1998 | Boucher |
| 5,820,953 | A | 10/1998 | Beer et al. |
| 5,826,101 | A | 10/1998 | Beck et al. |
| 5,833,368 | A | 11/1998 | Kaufman |
| 5,855,435 | A | 1/1999 | Chiesa |
| 5,862,101 | A | 1/1999 | Haas et al. |
| 5,873,483 | A | 2/1999 | Gortz et al. |
| 5,873,607 | A | 2/1999 | Waggoner |
| 5,882,116 | A | 3/1999 | Backus |
| 5,885,673 | A | 3/1999 | Light et al. |
| 5,906,278 | A | 5/1999 | Ponsi et al. |
| 5,908,246 | A | 6/1999 | Arimura et al. |
| 5,928,749 | A | 7/1999 | Forman |
| 5,938,013 | A | 8/1999 | Palumbo et al. |
| 5,939,156 | A | 8/1999 | Rossi et al. |
| 5,945,145 | A | 8/1999 | Narsutis et al. |
| 5,956,794 | A | 9/1999 | Skiba et al. |
| 5,993,962 | A | 11/1999 | Timm et al. |
| 5,996,797 | A | 12/1999 | Flaig |
| 5,997,177 | A | 12/1999 | Kaufman |
| 6,015,934 | A | 1/2000 | Lee et al. |
| 6,026,953 | A | 2/2000 | Nakamura et al. |
| 6,028,289 | A | 2/2000 | Robichaud et al. |
| 6,029,809 | A | 2/2000 | Skiba et al. |
| 6,056,141 | A | 5/2000 | Navarini et al. |
| 6,060,095 | A | 5/2000 | Scrimager |
| 6,065,591 | A | 5/2000 | Dill et al. |
| 6,066,437 | A | 5/2000 | Kosslinger |
| 6,076,969 | A | 6/2000 | Jaisle et al. |
| 6,077,551 | A | 6/2000 | Scrimager |
| 6,099,682 | A | 8/2000 | Krampe et al. |
| 6,113,271 | A | 9/2000 | Scott et al. |
| 6,125,614 | A | 10/2000 | Jones et al. |
| 6,126,009 | A | 10/2000 | Shiffler et al. |
| 6,126,317 | A | 10/2000 | Anderson et al. |
| 6,128,317 | A | 10/2000 | Anderson |
| 6,152,601 | A | 11/2000 | Johnson |
| 6,164,441 | A | 12/2000 | Guy et al. |
| 6,213,645 | B1 | 4/2001 | Beer |
| 6,228,450 | B1 | 5/2001 | Pedrini |
| D447,054 | S | 8/2001 | Hill |
| 6,273,610 | B1 | 8/2001 | Koyama et al. |
| 6,279,297 | B1 | 8/2001 | Latronico |
| 6,296,884 | B1 | 10/2001 | Okerlund |
| 6,299,355 | B1 | 10/2001 | Schneck |
| 6,309,104 | B1 | 10/2001 | Koch et al. |
| 6,309,105 | B1 | 10/2001 | Palumbo |
| 6,318,894 | B1 | 11/2001 | Derenthal |
| 6,352,364 | B1 | 3/2002 | Mobs |
| 6,364,113 | B1 | 4/2002 | Faasse, Jr. et al. |
| 6,365,255 | B1 | 4/2002 | Kittel et al. |
| 6,383,592 | B1 | 5/2002 | Lowry et al. |
| 6,402,379 | B1 | 6/2002 | Albright |
| 6,420,006 | B1 | 7/2002 | Scott |
| 6,427,420 | B1 | 8/2002 | Olivieri et al. |
| 6,428,867 | B1 | 8/2002 | Scott et al. |
| 6,446,811 | B1 | 9/2002 | Wilfong, Jr. |
| 6,450,685 | B1 | 9/2002 | Scott |
| 6,457,585 | B1 | 10/2002 | Huffer et al. |
| 6,461,043 | B1 | 10/2002 | Healy et al. |
| 6,461,708 | B1 | 10/2002 | Dronzek |
| 6,471,817 | B1 | 10/2002 | Emmert |
| 6,476,743 | B1 | 11/2002 | Brown et al. |
| 6,482,867 | B1 | 11/2002 | Kimura et al. |
| 6,502,986 | B1 | 1/2003 | Bensur et al. |
| 6,517,243 | B2 | 2/2003 | Huffer et al. |
| 6,519,918 | B2 | 2/2003 | Forman et al. |
| 6,539,691 | B2 | 4/2003 | Beer |
| 6,554,134 | B1 | 4/2003 | Guibert |
| 6,563,082 | B2 | 5/2003 | Terada et al. |
| 6,589,622 | B1 | 7/2003 | Scott |
| 6,592,260 | B1 | 7/2003 | Randall et al. |
| 6,594,872 | B2 | 7/2003 | Cisek |
| 6,612,432 | B2 | 9/2003 | Motson |
| 6,616,334 | B2 | 9/2003 | Faaborg et al. |
| 6,621,046 | B2 | 9/2003 | Kaji |
| 6,669,046 | B1 | 12/2003 | Sawada et al. |
| 6,691,886 | B1 | 2/2004 | Berndt et al. |
| 6,698,928 | B2 | 3/2004 | Miller |
| 6,726,054 | B2 | 4/2004 | Fagen et al. |
| 6,726,364 | B2 | 4/2004 | Perell et al. |
| 6,746,743 | B2 | 6/2004 | Knoerzer et al. |
| 6,750,423 | B2 | 6/2004 | Tanaka et al. |
| 6,767,604 | B2 | 7/2004 | Muir, Jr. et al. |
| 6,815,634 | B2 | 11/2004 | Sonoda et al. |
| 6,852,947 | B2 | 2/2005 | Tanaka |
| 6,865,860 | B2 | 3/2005 | Arakawa et al. |
| 6,889,483 | B2 | 5/2005 | Compton et al. |
| 6,918,532 | B2 | 7/2005 | Sierra-Gomez et al. |
| 6,929,400 | B2 | 8/2005 | Razeti et al. |

(56) References Cited

U.S. PATENT DOCUMENTS 6,951,999 B2 10/2005 Monforton et al.
6,969,196 B2 11/2005 Woodham et al.
6,983,875 B2 1/2006 Emmott
7,007,423 B2 3/2006 Andersson et al.
7,021,827 B2 4/2006 Compton et al.
7,032,757 B2 4/2006 Richards et al.
7,032,810 B2 4/2006 Benedetti et al.
7,040,810 B2 5/2006 Steele
7,048,441 B2 5/2006 Pape
7,051,877 B2 5/2006 Lin
7,165,888 B2 1/2007 Rodick
7,172,779 B2 2/2007 Castellanos et al.
7,207,718 B2 4/2007 Machacek
7,207,719 B2 4/2007 Marbler et al.
7,213,710 B2 5/2007 Cotert
7,228,968 B1 6/2007 Burgess
7,254,873 B2 8/2007 Stolmeier et al.
7,261,468 B2 8/2007 Schneider et al.
7,262,335 B2 8/2007 Motsch et al.
7,302,783 B2 12/2007 Cotert
7,344,744 B2 3/2008 Sierra-Gomez et al.
7,350,688 B2 4/2008 Sierra-Gomez et al.
7,351,458 B2 4/2008 Leighton
7,352,591 B2 4/2008 Sugahara
7,371,008 B2 5/2008 Bonenfant
7,404,487 B2 7/2008 Kumakura et al.
7,422,142 B2 9/2008 Arippol
7,470,062 B2 12/2008 Moteki et al.
7,475,781 B2 1/2009 Kobayashi et al.
7,516,599 B2 4/2009 Doll et al.
7,533,773 B2 5/2009 Aldridge et al.
7,600,641 B2 10/2009 Burgess
7,703,602 B2 4/2010 Saito et al.
7,708,463 B2 5/2010 Sampaio Camacho
7,717,620 B2 5/2010 Hebert et al.
7,740,923 B2 6/2010 Exner et al.
7,744,517 B2 6/2010 Bonenfant
7,758,484 B2 7/2010 Peterson
7,858,901 B2 12/2010 Krishnan et al.
7,963,413 B2 6/2011 Sierra-Gomez et al.
2,588,409 A1 7/2011 Aldridge
7,971,718 B2 7/2011 Aldridge
8,002,171 B2 8/2011 Ryan et al.
8,002,941 B2 8/2011 Exner et al.
8,029,428 B2 10/2011 Selle
8,038,349 B2 10/2011 Andersson et al.
8,114,451 B2 2/2012 Sierra-Gomez et al.
8,181,784 B2 5/2012 Bouthiette
8,240,546 B2 8/2012 Friebe et al.
8,262,830 B2 9/2012 Hebert
8,262,832 B2 9/2012 Hebert
8,308,363 B2 11/2012 Vogt
8,408,792 B2 4/2013 Cole
2001/0000480 A1 4/2001 Stagg et al.
2002/0068668 A1 6/2002 Chow et al.
2003/0019780 A1 1/2003 Parodli et al.
2003/0039412 A1 2/2003 Rodick
2003/0047695 A1 3/2003 Zik et al.
2003/0051440 A1 3/2003 Chow et al.
2003/0053720 A1 3/2003 Smith et al.
2003/0118255 A1 6/2003 Miller
2003/0127352 A1 7/2003 Buschkiel et al.
2003/0170357 A1 9/2003 Garwood
2003/0183637 A1 10/2003 Zappa et al.
2003/0183643 A1 10/2003 Fagen
2003/0210838 A1 11/2003 Steele
2003/0223656 A1 12/2003 Razeti
2004/0011677 A1 1/2004 Arakawa
2004/0035719 A1 2/2004 Ebbers et al.
2004/0060974 A1 4/2004 Dacey
2004/0062838 A1 4/2004 Castellanos
2004/0067326 A1 4/2004 Knoerzer
2004/0083680 A1 5/2004 Compton
2004/0091184 A1 5/2004 Miller
2004/0112010 A1 6/2004 Richards et al.
2004/0150221 A1 8/2004 Brown
2004/0175060 A1 9/2004 Woodham
2004/0180118 A1 9/2004 Renger et al.
2004/0206637 A1* 10/2004 Sierra-Gomez et al. ..... 206/1.5
2005/0000965 A1 1/2005 Boardman
2005/0031233 A1 2/2005 Varanese
2005/0084186 A1 4/2005 Caris
2005/0116016 A1 6/2005 LoDuca
2005/0117819 A1 6/2005 Kingsford et al.
2005/0220371 A1 10/2005 Machacek
2005/0247764 A1 11/2005 Sierra-Gomez
2005/0276885 A1 12/2005 Bennett
2005/0284776 A1 12/2005 Kobayashi et al.
2006/0018569 A1 1/2006 Bonenfant
2006/0066096 A1 3/2006 Kan
2006/0124494 A1 6/2006 Clark et al.
2006/0144911 A1 7/2006 Sierra-Gomez
2006/0171611 A1 8/2006 Rapparini
2006/0199717 A1 9/2006 Marbler et al.
2006/0251342 A1 11/2006 Forman
2006/0257056 A1 11/2006 Miyake et al.
2006/0257599 A1 11/2006 Exner
2006/0285779 A1 12/2006 Golas
2007/0023435 A1 2/2007 Sierra-Gomez et al.
2007/0023436 A1 2/2007 Sierra-Gomez et al.
2007/0095709 A1 5/2007 Saito
2007/0140600 A1 6/2007 Nowak et al.
2007/0209959 A1 9/2007 Burgess
2007/0269142 A1 11/2007 Tyska et al.
2007/0275133 A1 11/2007 Sierra-Gomez
2008/0013869 A1 1/2008 Forman
2008/0031555 A1 2/2008 Roberts
2008/0037911 A1 2/2008 Cole et al.
2008/0041750 A1 2/2008 Kohlweyer
2008/0053861 A1 3/2008 Mellin
2008/0060751 A1 3/2008 Arrindell
2008/0063324 A1 3/2008 Bernard et al.
2008/0063759 A1 3/2008 Raymond
2008/0063760 A1 3/2008 Raymond et al.
2008/0131035 A1 6/2008 Rogers
2008/0135428 A1 6/2008 Tallier
2008/0152264 A1 6/2008 Polusa et al.
2008/0156861 A1 7/2008 Sierra-Gomez et al.
2008/0159666 A1 7/2008 Exner et al.
2008/0203141 A1 8/2008 Friebe et al.
2008/0214376 A1 9/2008 Bonenfant
2008/0240627 A1 10/2008 Cole et al.
2008/0273821 A1 11/2008 Doll
2008/0292225 A1 11/2008 Dayrit et al.
2009/0001143 A1 1/2009 Cowan et al.
2009/0014491 A1 1/2009 Fuisz et al.
2009/0022431 A1 1/2009 Conner
2009/0028472 A1 1/2009 Andersson et al.
2009/0053372 A1 2/2009 Hambrick et al.
2009/0074333 A1 3/2009 Griebel et al.
2009/0097786 A1 4/2009 Goglio et al.
2009/0161995 A1 6/2009 Henderson
2009/0190866 A1 7/2009 Hughes
2009/0211938 A1 8/2009 Aldridge
2009/0226117 A1 9/2009 Davis et al.
2009/0232425 A1 9/2009 Tai
2009/0273179 A1 11/2009 Scott et al.
2010/0002963 A1 1/2010 Holbert et al.
2010/0018974 A1 1/2010 Lyzenga et al.
2010/0019022 A1 1/2010 Ryan et al.
2010/0111453 A1 5/2010 Dierl
2010/0113241 A1 5/2010 Hebert et al.
2010/0172604 A1 7/2010 Andersson et al.
2010/0226598 A1 9/2010 Stoeppelmann
2010/0230303 A1 9/2010 Buse et al.
2010/0230411 A9 9/2010 Sierra-Gomez et al.
2010/0278454 A1 11/2010 Huffer
2010/0303391 A9 12/2010 Cole et al.
2011/0049158 A1 3/2011 Bouthiette
2011/0127319 A1 6/2011 Golden
2011/0132976 A1 6/2011 Drewnowski et al.
2011/0147443 A1 6/2011 Igo
2011/0204056 A1 8/2011 Veternik et al.
2011/0253718 A1 10/2011 Sierra-Gomez et al.

(56) References Cited

U.S. PATENT DOCUMENTS

| | | | |
|---|---|---|---|
| 2012/0128835 | A1 | 5/2012 | Lyzenga et al. |
| 2012/0177307 | A1 | 7/2012 | Duan |
| 2013/0004626 | A1 | 1/2013 | Renders et al. |
| 2013/0011527 | A1 | 1/2013 | Renders |
| 2013/0064477 | A1 | 3/2013 | Vogt |
| 2013/0064934 | A1 | 3/2013 | Vogt |
| 2013/0114918 | A1 | 5/2013 | Lyzenga |
| 2013/0121623 | A1 | 5/2013 | Lyzenga |
| 2013/0121624 | A1 | 5/2013 | Lyzenga |
| 2013/0270268 | A1 | 10/2013 | Lyzenga |

FOREIGN PATENT DOCUMENTS

| | | | |
|---|---|---|---|
| AU | 2004295316 | | 6/2005 |
| AU | 2005254459 | | 12/2005 |
| BR | DI 5500885-2 | F | 11/2001 |
| BR | DI 6202030-7 | F | 4/2003 |
| BR | DI 6804636-7 | F | 10/2009 |
| CN | 1224396 | A | 7/1999 |
| CN | 1781819 | A | 6/2006 |
| DE | 1848870 | | 3/1962 |
| DE | 9003401 | | 5/1990 |
| DE | 9005297 | | 8/1990 |
| DE | 9014065 | | 2/1991 |
| DE | 90140656 | | 4/1991 |
| DE | 4134567 | | 1/1993 |
| DE | 4241423 | | 6/1994 |
| DE | 19738411 | | 4/1999 |
| DE | 19822328 | | 11/1999 |
| DE | 202007005487 | | 6/2007 |
| DE | 102007030267 | | 1/2009 |
| EP | 0085289 | | 8/1983 |
| EP | 0307924 | A2 | 3/1989 |
| EP | 0388310 | | 9/1990 |
| EP | 408831 | A1 | 1/1991 |
| EP | 0447636 | | 9/1991 |
| EP | 474981 | | 3/1992 |
| EP | 488967 | | 6/1992 |
| EP | 0546369 | | 6/1993 |
| EP | 0608909 | | 8/1994 |
| EP | 0613824 | | 9/1994 |
| EP | 0629561 | | 12/1994 |
| EP | 0661154 | | 7/1995 |
| EP | 0667828 | | 8/1995 |
| EP | 0669204 | | 8/1995 |
| EP | 0669204 | B2 | 8/1995 |
| EP | 0744357 | | 11/1996 |
| EP | 0752375 | | 1/1997 |
| EP | 0758993 | | 2/1997 |
| EP | 0905048 | | 3/1999 |
| EP | 0796208 | | 1/2000 |
| EP | 1046594 | | 10/2000 |
| EP | 1056066 | | 11/2000 |
| EP | 1086906 | | 3/2001 |
| EP | 1136379 | | 9/2001 |
| EP | 1318081 | A1 | 6/2003 |
| EP | 1350741 | | 8/2003 |
| EP | 1375380 | | 1/2004 |
| EP | 1382543 | | 1/2004 |
| EP | 1437311 | | 7/2004 |
| EP | 1449789 | | 8/2004 |
| EP | 1457424 | | 9/2004 |
| EP | 1468936 | | 10/2004 |
| EP | 1477425 | | 11/2004 |
| EP | 1488936 | | 12/2004 |
| EP | 1608567 | | 12/2005 |
| EP | 1609737 | | 12/2005 |
| EP | 1619137 | | 1/2006 |
| EP | 1637472 | | 3/2006 |
| EP | 1712468 | | 10/2006 |
| EP | 1755980 | | 2/2007 |
| EP | 1760006 | | 3/2007 |
| EP | 1770025 | | 4/2007 |
| EP | 1846306 | | 10/2007 |
| EP | 1858776 | | 11/2007 |
| EP | 1873082 | A1 | 1/2008 |
| EP | 1908696 | | 4/2008 |
| EP | 1939107 | | 7/2008 |
| EP | 1975081 | | 10/2008 |
| EP | 1712488 | | 12/2008 |
| EP | 2033910 | | 3/2009 |
| EP | 2189506 | | 5/2010 |
| FR | 1327914 | | 4/1963 |
| FR | 2674509 | | 10/1992 |
| FR | 2693988 | | 1/1994 |
| FR | 2766794 | | 2/1999 |
| FR | 2783512 | | 3/2000 |
| GB | 2171077 | | 8/1986 |
| GB | 2266513 | | 11/1993 |
| GB | 2276095 | | 9/1994 |
| JP | 57-163658 | | 10/1982 |
| JP | 6080405 | | 5/1985 |
| JP | 62-171479 | | 10/1987 |
| JP | 63-022370 | | 1/1988 |
| JP | 0581083 | | 11/1993 |
| JP | 9150872 | | 6/1997 |
| JP | 09156677 | | 6/1997 |
| JP | 10059441 | | 3/1998 |
| JP | 10129685 | | 5/1998 |
| JP | H10-152179 | | 9/1998 |
| JP | 10-120016 | | 12/1998 |
| JP | 11198977 | | 7/1999 |
| JP | 2000335542 | | 12/2000 |
| JP | 2001114357 | | 4/2001 |
| JP | 2002002805 | A | 1/2002 |
| JP | 2002104550 | A | 4/2002 |
| JP | 200326224 | | 1/2003 |
| JP | 2003072774 | | 3/2003 |
| JP | 2005015015 | | 1/2005 |
| JP | 2006062712 | | 3/2006 |
| JP | 2007045434 | | 2/2007 |
| NZ | 555274 | | 12/2008 |
| WO | 86/06350 | | 11/1986 |
| WO | 94/11270 | | 5/1994 |
| WO | 9411270 | A1 | 5/1994 |
| WO | 9532902 | | 12/1995 |
| WO | 9725200 | | 7/1997 |
| WO | 0064755 | | 11/2000 |
| WO | 01/40073 | | 6/2001 |
| WO | 02/064365 | | 8/2002 |
| WO | 02066341 | | 8/2002 |
| WO | 03013976 | | 2/2003 |
| WO | 03/037727 | | 5/2003 |
| WO | 03035504 | | 5/2003 |
| WO | 03059776 | | 7/2003 |
| WO | 2004/087527 | | 10/2004 |
| WO | 2005/056420 | | 6/2005 |
| WO | 2005054079 | | 6/2005 |
| WO | 2005/110042 | | 11/2005 |
| WO | 2005110865 | | 11/2005 |
| WO | 2005110876 | | 11/2005 |
| WO | 2005110885 | | 11/2005 |
| WO | 2005120989 | | 12/2005 |
| WO | 2005123535 | | 12/2005 |
| WO | 2006055128 | | 5/2006 |
| WO | 2006080405 | | 8/2006 |
| WO | 2006108614 | | 10/2006 |
| WO | 2007090419 | | 8/2007 |
| WO | 2008051813 | | 5/2008 |
| WO | 2008062159 | | 5/2008 |
| WO | 2008074060 | | 6/2008 |
| WO | 2008108969 | | 9/2008 |
| WO | 2008115693 | | 9/2008 |
| WO | 2008122961 | | 10/2008 |
| WO | 2008146142 | | 12/2008 |
| WO | 2009065120 | | 5/2009 |
| WO | 2009111153 | | 9/2009 |
| WO | 2010002834 | | 1/2010 |
| WO | 2010046623 | | 4/2010 |
| WO | 2010051146 | | 5/2010 |
| WO | 2010080810 | | 7/2010 |
| WO | 2010084336 | | 7/2010 |
| WO | 2010088492 | | 8/2010 |

(56) References Cited

FOREIGN PATENT DOCUMENTS

| | | |
|---|---|---|
| WO | 2010114879 | 10/2010 |
| WO | 2010149996 | 12/2010 |
| WO | 2011004156 | 1/2011 |
| WO | 2011121337 | 10/2011 |
| WO | 2011/146616 | 11/2011 |
| WO | 2011/146627 | 11/2011 |
| WO | 2011/146658 | 11/2011 |
| WO | 2012/098412 | 7/2012 |

OTHER PUBLICATIONS

English Translation of JP S60-80405, published Aug. 5, 1985.
English Translation of JP Official Notice of Rejection mailed on Feb. 14, 2012 in JP Appl. No. 2009-172352.
English Translation of JP 2003-26224 published Jan. 29, 2003.
English Translation of JP 1998-152179 published on Sep. 6, 1998.
Fuji Packaging GmbH Fachpack brochure, Oct. 11-12, 2001, 2 pages.
European Packaging Pack Report, NR, May 5, 2001 and partial translation thereof, 6 pages.
"Cheese Range", Mintel gnpd, Jan. 26, 2001, Mintel Publishing.
"Elite Edam Cheese", Mintel gnpd, Dec. 3, 2001, Mintel Publishing.
"Margin." Merriam-Webster Online Dictionary. 2010. Merriam-Webster [online], retrieved on May 6, 2010. Retrieved from the Internet:URL:<http://www.merriam-webster.com/dictionary/margin>.
"New Easy Peel Cheese Packaging", Mintel gnpd, Aug. 10, 2001, Mintel Publishing.
"New on the Shelf-Produce Instruction and Packaging Trends", Circle Reader Service Card No. 93, Aug. 1998, Baking & Snack.
"Soft Bread Sticks", Mintel gnpd, Mar. 20, 1998, Mintel Publishing.
Giant Baby Wipes package, item No. 80203-91, resealable package having die cut-out portions (tabs) which remain affixed to the top of the package after label is withdrawn from the top, whereby tamper evidence is indicated by a misalignment of thedie cut-.
English Translation of JP 2001-114357 published on Apr. 24, 2001.
Patent Abstracts of Japan, vol. 1997 No. 10, Oct. 31, 1997 and JP09156677 A (Fuji Seal Co. Ltd.) (Jul. 6, 1997) abstract in English and 7 figures.
Reclosure system lengthens food life, Packaging News PPMA Preview, Sep. 2001, p. 40.
Reseal-it. [Homepage of Macfarlane Group] [Online] 2005, Available at: http//www.real-it.se [accessed Mar. 14, 2005].
English Translation of BR DI 5500885-2 F, published Nov. 20, 2001, 1 page.
English Translation of BR DI 6202030-7 F, published Apr. 15, 2003, 1 page.
English Translation of BR DI 6804636-7 F, published Oct. 20, 2009, 1 page.
European Search Report, EP10305289 citing DE1848870U, 3 pages.
English Translation of JP 1998-152179 (H10-152179 A), published on Sep. 6, 1998, 6 pages.
English Translation of JP 2001-114357 published on Apr. 24, 2001, 8 pages.
English Translation of JP 2003-26224 published Jan. 29, 2003, 13 pages.
"Wall's Bacon A Sizzling Success Story" and The Grocer: "When sealed delivers", the second page of which bears a date of Aug. 21, 1999.
Defendants' Answer, Affirmative Defenses, and Counterclaims Responsive to Complaint, dated Apr. 5, 2012, 25 pages.
Defendants' Final Invalidity Contentions—Exhibit A-1, dated Sep. 27, 2013, 55 pages.
Defendants' Final Invalidity Contentions—Exhibit A-2, dated Sep. 27, 2013, 35 pages.
Defendants' Final Invalidity Contentions—Exhibit A-3, dated Sep. 27, 2013, 34 pages.
Defendants' Final Invalidity Contentions—Exhibit A-4, dated Sep. 27, 2013, 35 pages.
Defendants' Final Invalidity Contentions—Exhibit B-1, dated Sep. 27, 2013, 135 pages.
Defendants' Final Invalidity Contentions—Exhibit B-2, dated Sep. 27, 2013, 64 pages.
Defendants' Final Invalidity Contentions—Exhibit B-3, dated Sep. 27, 2013, 140 pages.
Defendants' Final Invalidity Contentions—Exhibit B-4, dated Sep. 27, 2013, 273 pages.
Defendants' Final Invalidity Contentions—Exhibit B-5, dated Sep. 27, 2013, 146 pages.
Defendants' Final Invalidity Contentions—Exhibit B-6, dated Sep. 27, 2013, 226 pages.
Defendants' Final Invalidity Contentions Pursuant to LPR 3.1, dated Sep. 27, 2013, 22 pages.
Defendants' Final Unenforceability Contentions Pursuant to LPR 3.1, dated Sep. 27, 2013, 14 pages.
Defendants' Initial Non-Infringement Contentions Pursuant to LPR 2.3(a), dated May 17, 2013, 7 pages.
Defendants' Invalidity Contentions—Exhibit A-1, dated May 17, 2013, 55 pages.
Defendants' Invalidity Contentions—Exhibit A-2, dated May 17, 2013, 35 pages.
Defendants' Invalidity Contentions—Exhibit A-3, dated May 17, 2013, 34 pages.
Defendants' Invalidity Contentions—Exhibit A-4, dated May 17, 2013, 35 pages.
Defendants' invalidity Contentions—Exhibit A-5, dated May 17, 2013, 39 pages.
Defendants' Invalidity Contentions Pursuant to LPR 2.3, dated May 17, 2013, 23 pages.
Defendants' LPR 2.3 Initial Non-Infringement Contentions Exhibit A, dated May 17, 2013, 39 pages.
Defendants' Unenforceability Contentions Pursuant to LPR 2.3, dated May 17, 2013, 13 pages.
English Translation of Japanese Official Notice of Rejection mailed on Feb. 14, 2012 in JP Application No. 2009-172352, 3 pages.
English Translation of Jp Official Notice of Rejection mailed on Feb. 14, 2012 in JP Appl. No. 2009-172352, 3 pages.
English Translation of JP Official Notice of Rejection mailed on Jan. 29, 2013 in JP Appl. No. 2008-087152, 5 pages.
European Packaging Pack Report, NR. 5 Mai 2001 and partial translation thereof, 6 pages.
European Search Report 06118142.6 dated May 3, 2007, 10 pages.
Fuji Packaging GmbH Fachpack brochure, Oct. 11-12, 2001; 2 pgs.
Giant Baby wipes package, item No. 80203-91, resealable package having die cut-out portions (tabs) which remain affixed to the top of the package after label is withdrawn from the top, whereby tamper evidence is indicated by a misalignment of the die cut-out portions with the holes formed in the label.
Global Brands' LPR 2.5 Initial Response to Defendants' Initial Invalidity Contentions Chart Ex. A-1, dated May 31, 2013, 30 pages.
Global Brands' LPR 2.5 Initial Response to Defendants' Initial Invalidity Contentions Chart Ex. A-2, dated May 31, 2013, 20 pages.
Global Brands' LPR 2.5 Initial Response to Defendants' Initial Invalidity Contentions Chart Ex. A-3, dated May 31, 2013, 21 pages.
Global Brands' LPR 2.5 Initial Response to Defendants' Initial Invalidity Contentions Chart Ex. A-5, dated May 31, 2013, 14 pages.
Global Brands FPR 2.5 Initial Response to Defendants' Initial Invalidity Contentions Chart Ex. A-4, dated May 31, 2013, 17 pages.
International Search Report, PCT/EP2011/054250 dated Jun. 28, 2011, 3 pages.
Machine translation of DE 202007005487, published Jun. 14, 2007, provided by Espacenet, 3 pages.
Machine translation of DE9014065, published Mar. 19, 2009, provided by Espacenet, 9 pages.
Machinery Update, Mar./Apr. 2002, pp. 56-62.
Machinery Update, Sep./Oct. 2001, pp. 46-47.
Opposition to EP1679269 filed by Awapatent AB, Heisingborg, Sweden. May 2, 2012.
Opposition to EP1679269 filed by Bahlse GmbH and Co. KG, Apr. 30, 2012.
Partial European Search Report for Appl. No. EP11155570 dated Jun. 12, 2011, 9 pages.

(56) References Cited

OTHER PUBLICATIONS

Plaintiffs Initial Response to Defendant's Initial Invalidity Contentions, dated May 31, 2013, 20 pages.
Plaintiffs Answer to Counterclaims of Defendant, dated Apr. 26, 2013, 20 pages.
Plaintiffs Complaint for Patent Infringement, dated Jan. 16, 2013, 7 pages.
Reclosure system lengthens food life, Packaging News PPMA Preview, Sep. 2001, 4 pages.
Reseal-It. Web page Internet print out accessed Mar. 14, 2005; 19 pages.
Machine translation of CN 1781819A published Jun. 7, 2006 from google.com/patents; 13 pages, accessed Jun. 5, 2014.

* cited by examiner

RESEALABLE CLOSURE WITH PACKAGE INTEGRITY FEATURE

CROSS-REFERENCE TO RELATED APPLICATIONS

This application is a continuation of prior application Ser. No. 11/616,386, filed Dec. 27, 2006, which issued as U.S. Pat. No. 8,114,451 on Feb. 14, 2014.

FIELD OF THE INVENTION

The present invention relates to a resealable closure for packages storing articles and, more particularly, resealable closures for packages having a package integrity indicator.

BACKGROUND OF THE INVENTION

Some containers for food products, such as cookies and other snacks, typically include an outer wrapper. In one type of container, the wrapper surrounds a frame which acts as a tray to hold the food product and to protect the food product from damage. Other food products come packaged in plastic trays, such as thermoform trays which are sealed on the top using some type of lidding material. One recent advancement in the art of food container closures includes a resealable closure disclosed in U.S. Pat. No. 6,918,532(hereinafter "the '532 patent"), herein incorporated by reference, which discloses a wrapper which forms a top of the container, which has an access opening covered by a resealable sealing panel.

In the packaging art, different methods have been used to indicate whether a package has been previously opened or whether the integrity of the package has been compromised, which is often referred to in the art as "tamper-evident." For example, in the tissue wipes packaging art of U.S. Pat. No. 6,428,867 (hereinafter "the '867 patent"), a means for indicating package integrity includes a tamper-evident tab with one or more ink layers which is initially an integral part of a sealing panel prior to the package being opened for a first time. The tab is transferred with one of the ink layers from the sealing panel to the top of the package when the closure has been opened for a first time. Tamper-evidence is indicated in a misalignment of the sealing panel with an image on the transferred tab, which is visible through a transparent outer layer of the sealing panel, after the sealing panel has been resealed to the top of the package.

There is a need for improvement in the art for package integrity indicators for a resealable closure, preferably suitable for use with a resealable closure for containers or packages containing food items.

SUMMARY OF THE INVENTION

The present invention generally relates to a resealable closure for a container formed from a two-ply material, which has a package integrity indicator in the form of a coating of material, such as ink or paint, which transfers between a sealing panel and a film layer disposed therebelow when the container has been opened for a first time.

The present invention, in one form, comprises a package integrity closure comprising a film layer forming a top of a container and having a flap defining an access opening to gain access to the contents of the container. A sealing panel completely covers the flap of the film layer. A releasable adhesive is provided on either or both the sealing panel or the film layer for adhering the sealing panel to the film layer. The sealing panel is releasable from the film layer by pulling the sealing panel back in a peeling direction and reclosable against the top to seal the access opening when the sealing panel is moved back against the top. A coating of transferable material is disposed on either the film layer adjacent the access opening on a surface facing the sealing panel or on the sealing panel on a surface facing the film layer. The coating is transferable from either the film layer or sealing panel to the sealing panel or the film layer, respectively. The coating transfer occurs without a transfer of a portion of the film layer or sealing panel bonded to the coating when the sealing panel is pulled back from the film layer for a first time to thereby provide a visual indication that the closure has been previously opened. The sealing panel can either be a top layer of a multilayer material forming the top of the container, such as the container disclosed in U.S. patent application Ser. No. 11/500,497, herein incorporated by reference, or a discrete label applied over a film layer forming the top of the container, such as the container of the '532 patent. Further, the perimeter edge of the sealing panel can be either linear or nonlinear such as a zigzag pattern.

Advantageously, the coating of transferable material is a different color or pattern than that of the film layer or sealing panel. If the coating is initially applied to the sealing panel, evidence that the closure has been previously opened is observable in the form of a partial outline of the coating transferred to the film layer adjacent the sealing panel, which is visible due to a slight misalignment of the sealing panel with the film layer when the sealing panel is reapplied to the top of the container upon closure. If the perimeter edge of the sealing panel is nonlinear, such as a zigzag pattern, a slight misalignment of the zigzag pattern between the sealing panel and the film layer will be visible as a slightly misaligned pattern.

A secondary evidence of package integrity is provided in the form of a reduction in peel force between the sealing panel and the film layer after the closure has been previously opened and subsequently resealed due to a deadening effect resulting from the transfer of the coating from the sealing panel or film layer to the adhesive on the opposite surface or the transfer of adhesive with coating material from either the film layer or sealing panel to the opposite surface.

The present invention, in another form thereof, concerns a package integrity indicating closure comprising an at least two-ply material comprising a first film layer adhesively joined to a second film layer. A first tear line is formed in the first film layer defining a first panel for providing an access opening through the first film layer when separated from the first film layer along the first tear line. A second film layer having a second layer tear line defines a sealing panel which completely covers the first panel. The sealing panel is releasably adhered to the first film layer, such that the sealing panel is separable from the first film layer to expose the access opening. A coating of transferable material is on either the sealing panel on a surface facing the first film layer or on the first film layer facing the sealing panel so that upon opening the closure, a portion of the coating is transferred from between the second film layer and the first film layer to provide a visual indication that the closure has been opened after the sealing panel has been peeled back from the first film layer for a first time.

The present invention, in another form thereof, concerns a package integrity indicating closure for a container comprising an at least two-ply material comprising an inner layer adhesively joined to an outer layer and forming a top of the container. The inner layer has an inner layer panel and the outer layer has a sealing panel formed therein, which completely covers the inner layer panel. The first panel and the sealing panel are permanently joined to each other to provide an access opening into the container. A releasable adhesive is provided on one or both the sealing panel and the inner layer for adhering the sealing panel to the inner layer. The sealing panel is releasable from the inner layer by pulling the sealing panel back in a peeling direction and reclosable against the top to seal the opening when the sealing panel is moved back against the top. A coating of transferable material is on either the sealing panel or on the inner layer facing the sealing panel so that upon opening the closure, a portion of the coating is transferred from between the sealing panel and the inner film layer to provide a visual indication that the closure has been opened after the sealing panel has been peeled back from the inner layer for a first time.

The present invention, in another form thereof, relates to a package integrity indicating food container comprising a tray and an at least two-ply material comprising an inner layer adhesively joined to an outer layer to form a top over the tray. The top is formed to provide an access opening for access to the food items disposed in the tray. The inner layer has a first panel and the outer layer has a sealing panel formed therein, which completely covers the first panel. The first panel and sealing panel are permanently joined to each other to form the access opening into the container. A coating of transferable material is on either the outer layer adjacent the access opening on a surface facing the inner layer or the inner layer facing the sealing panel. A releasable adhesive is provided on either or both the inner layer on a perimeter outside the first panel or the sealing panel, which lies thereover for adhering the sealing panel to the inner layer. The sealing panel is releasable from the inner layer by pulling the sealing panel layer back in a peeling direction and reclosable against the top to seal the opening when the sealing panel is moved back against the top whereby, upon opening the closure for a first time, a portion of the coating is transferred from between the outer layer and the inner layer to provide a visual indication that the closure has been opened.

Food items disposed in the container may include cookies, crackers, peanuts, cheese, sliced meats and semi-solid foods.

Other features and advantages of the present invention are stated in or apparent from detailed descriptions of the presently preferred embodiments of the invention found herebelow.

DETAILED DESCRIPTION

Figure 1:
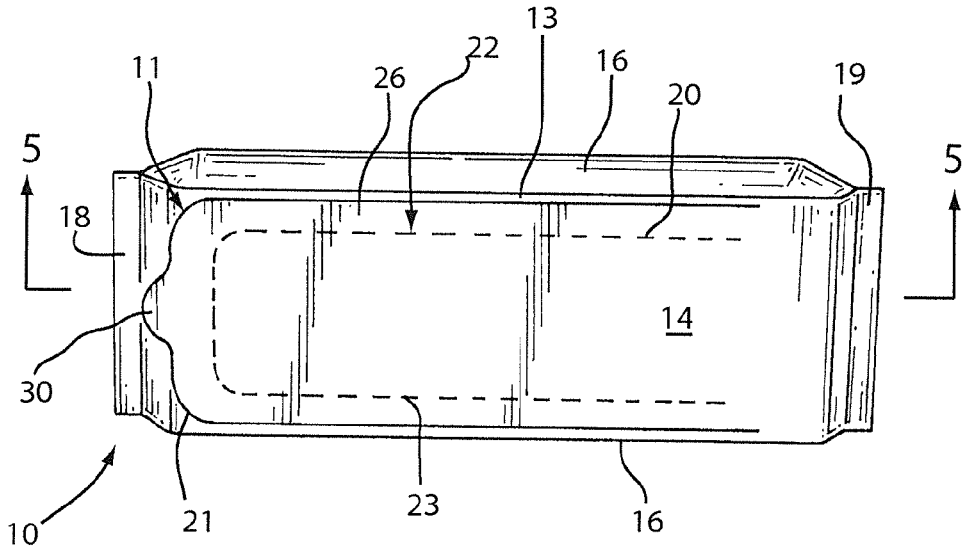
FIG. 1 is a perspective view of a package including an exemplary closure prior to an initial opening, according to the present invention.

Referring to the figures and, in particular, FIGS. 1-6, there is shown package 10 with closure 11, which incorporates a package integrity feature. Package 10 includes a two-ply wrapper comprising a first, inner film layer 12 and a second, outer film layer 13, forming a top or upper surface 14, sides 16, lower surface (not shown), and crimped ends 18, 19. The inner film layer 12 and outer film layer 13 are formed from a polymeric film or other flexible material that has been cut, folded or otherwise pressed to define an inner space or receptacle for receiving the desired product, such as food items, to be provided within the package 10. Package 10 can be used to store and distribute food items such as cookies, crackers, candy or other items. The outer film layer 13 may include graphics or other indicia to identify the contents of the package 10.

Advantageously, the inner film layer 12 is coextensively formed and adhesively joined to the outer film layer 13. During the manufacturing of package 10, the inner film layer 12 is die cut along first tear line 20 and the outer film layer 13 is die cut along a second tear line 21, as disclosed in U.S. Patent Application Publication No. 2005/0276525, herein incorporated by reference.

The first tear line 20 is formed as a continuous tear line to define a panel 22. The panel 22 is separated from the remainder of the inner film layer 12 to expose an opening 24 (FIGS. 2A, 4 and 6), whereby access to the contents of the package 10 may be gained.

The second tear line 21 defines sealing panel 26 of the outer film layer 13. The sealing panel 26 extends beyond the periphery of the first tear line 20, adjacent to the opening 24, so that the sealing panel 26 completely covers and extends beyond the perimeters of the panel 22.

The side of the sealing panel 26 which faces the inner film layer 12 is coated with a releasable adhesive 27 (see FIGS. 2A, 3, 5 and 6) so that the sealing panel 26 may be releasably secured to the inner film layer 12 at a position adjacent to the panel 22. Alternatively, or along with resealable adhesive 27, resealable adhesive 29 can be coated on the inner film layer 12 adjacent the outside perimeter of the panel 22. The releasable adhesive can be any pressure sensitive adhesive which allows resealing and includes, but is not limited to, the adhesives disclosed in U.S. Patent Application Publication No. 2006/0144911, herein incorporated by reference. The sealing panel 26 is provided with a tab 30 or other gripping feature which is not coated with the adhesive 27 so that the sealing panel 26 may be peeled back from the inner film layer 12 to open the package 10.

A coating of transferable material 28, such as ink or paint, is disposed or otherwise printed on a perimeter edge 34 of the sealing panel 26 on top of the adhesive 27. Coating 28 is any appropriate transferable paint or ink known in the packaging art including but not limited to those disclosed in U.S. Patent Application Publication No. 2006/0257599, herein incorporated by reference.

Alternatively, coating 28 can be applied directly to the sealing panel 26 rather than on top of adhesive 27. Adhesive 27 can either be applied to the sealing panel adjacent the coating only or on top of the coating as well.

Adhesive 29 is applied along the inner film layer 12 approximate the second tear line 21. Adhesive 29 can be any known adhesive in the art which, advantageously, has a bond strength between the adhesive 29 and the coating 28 which is greater than the bond between the coating 28 and the sealing panel 26 and the bond between coating 28 and adhesive 27. When the closure 11 is opened for a first time, a portion of the coating 28 will be transferred from the sealing panel 26 to the adhesive 29 covered portion of the inner film layer 12, as will be discussed in greater detail below.

In an alternative embodiment, there is no adhesive 29 applied along the inner film layer 12. Instead, coating 28 forms a sufficiently strong bond with the inner film layer 12 such that upon opening closure 11 for a first time, some or all of the coating 28 will be transferred from the sealing panel 26 to the inner film layer 12.

Figure 2A:
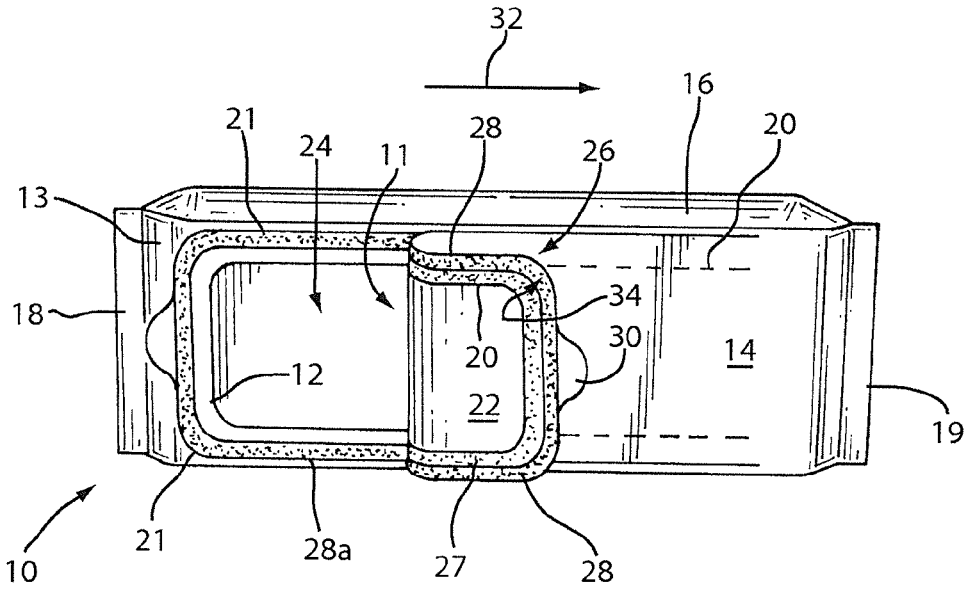
FIG. 2A is the package of FIG. 1, shown in a partially opened condition.
Figure 2B:
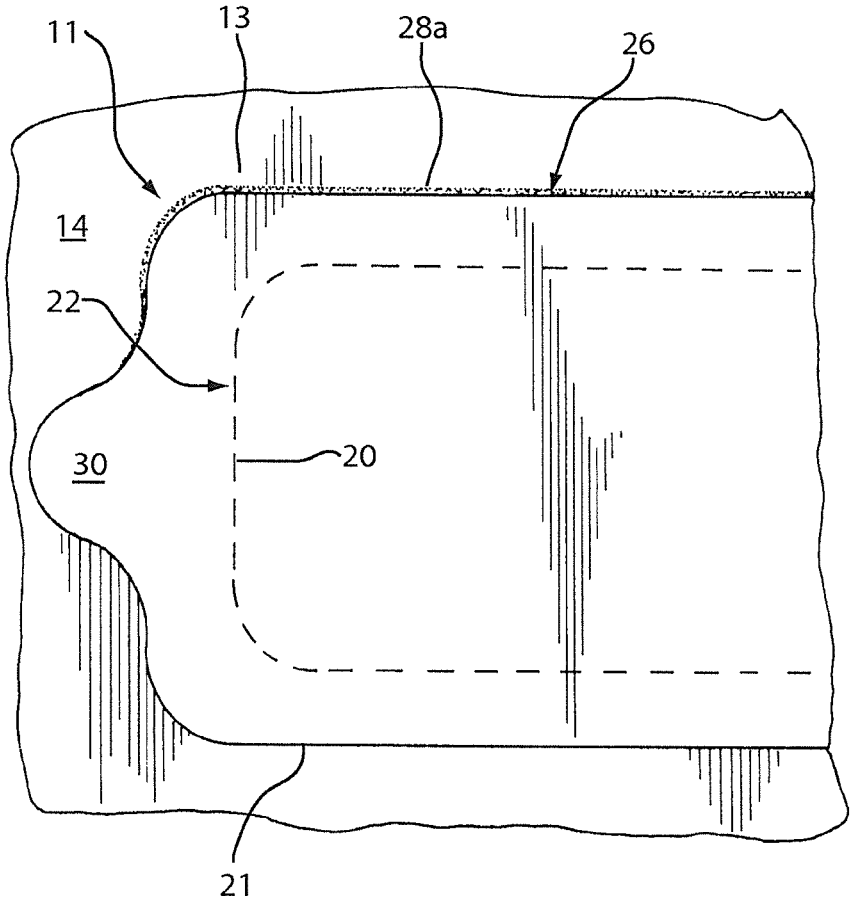
FIG. 2B is a partial enlargement of the package of FIG. 1, after the package has been opened and subsequently closed.
Figure 5:
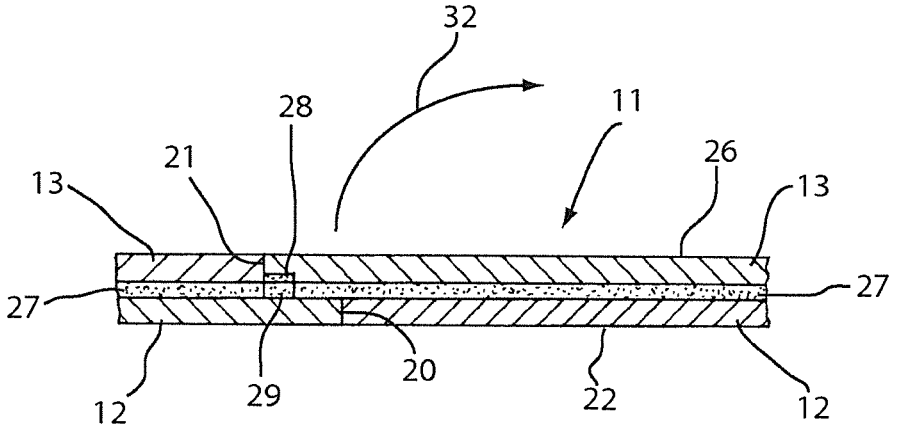
FIG. 5 is a partial enlarged cross-sectional view of the closure of FIG. 1, taken along line 5-5 of FIG. 1.
Figure 6:
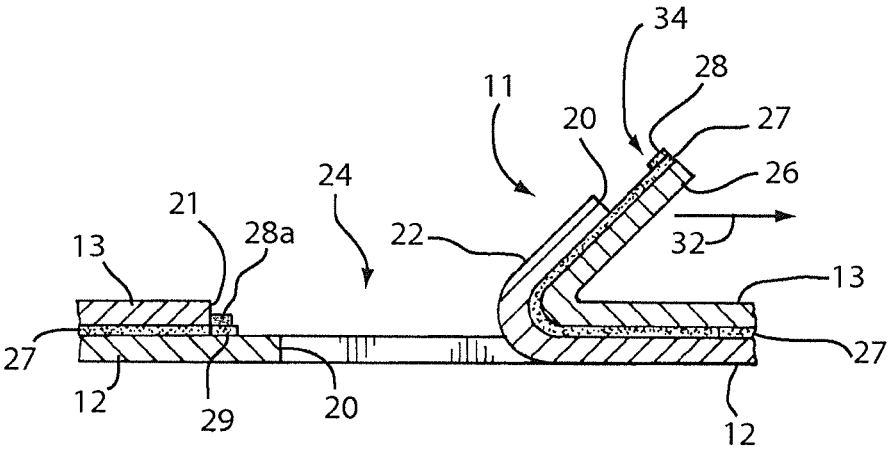
FIG. 6 is a partial enlarged cross-sectional view of the closure, similar to FIG. 5, depicting an initial opening of the closure.
Figure 7:
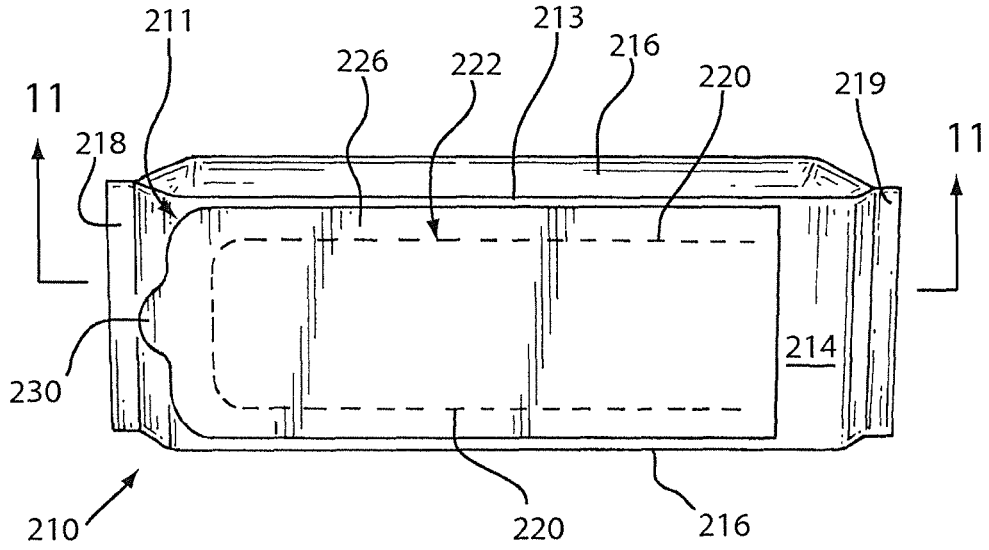
FIG. 7 is a perspective view of another package including an exemplary closure prior to an initial opening, according to another embodiment of the present invention.

As shown in FIGS. 5 and 6, the first panel 22 is separated from the remainder of the inner film layer 12 along the first tear line 20 and remains adhered to the sealing panel 26 as the sealing panel 26 is peeled back in a peeling direction indicated by arrow 32 (FIGS. 2*a* and 5) to open the package 10. After the contents of the package have been accessed and it is desired to reseal the package 10, the sealing panel may be reapplied to the inner film layer 12, approximately in its original position, as depicted in FIG. 2B. Because the sealing panel 26 extends beyond the periphery of the panel 22, the releasable adhesive 27 disposed thereon facilitates the resealing of the package 10 with the panel 22 positioned over the access opening 24.

In addition, when the sealing panel 26 is peeled away from the inner film layer 12 to separate the panel 22 for a first time, a portion of the coating 28, namely transferred coating 28*a*, is separated from the sealing panel 26 and remains or adheres to the adhesive 29 disposed on the inner film layer 12. Advantageously, the color of the coating 28 is different than the color of the top surface of the package 10. Although a residual amount of coating 28 is depicted, alternatively, all of coating 28 can be transferred from the sealing panel 26 to the inner film layer 12.

Referring specifically to FIG. 2B, when the sealing panel 26 is reapplied to the top of the package 10, due to inevitable slight misalignment of the sealing panel 26 relative to the inner film layer 12, a portion of the transferred coating 28*a* will be visible and thus indicate that the package 10 has been previously opened.

In addition to the visual indication, package integrity is further evident after the package has been previously opened and resealed due to a deadening effect of adhesive 29 due to the transfer of the coating 28 thereto. As a result, the transferred coating 28*a* deadens the adhesive 29 along the portions where the coating 28*a* has been transferred. Consequently, a previously opened package, having a deadened portion of the adhesive 29, is easier to open a second and subsequent time than it is initially.

Figure 2C:
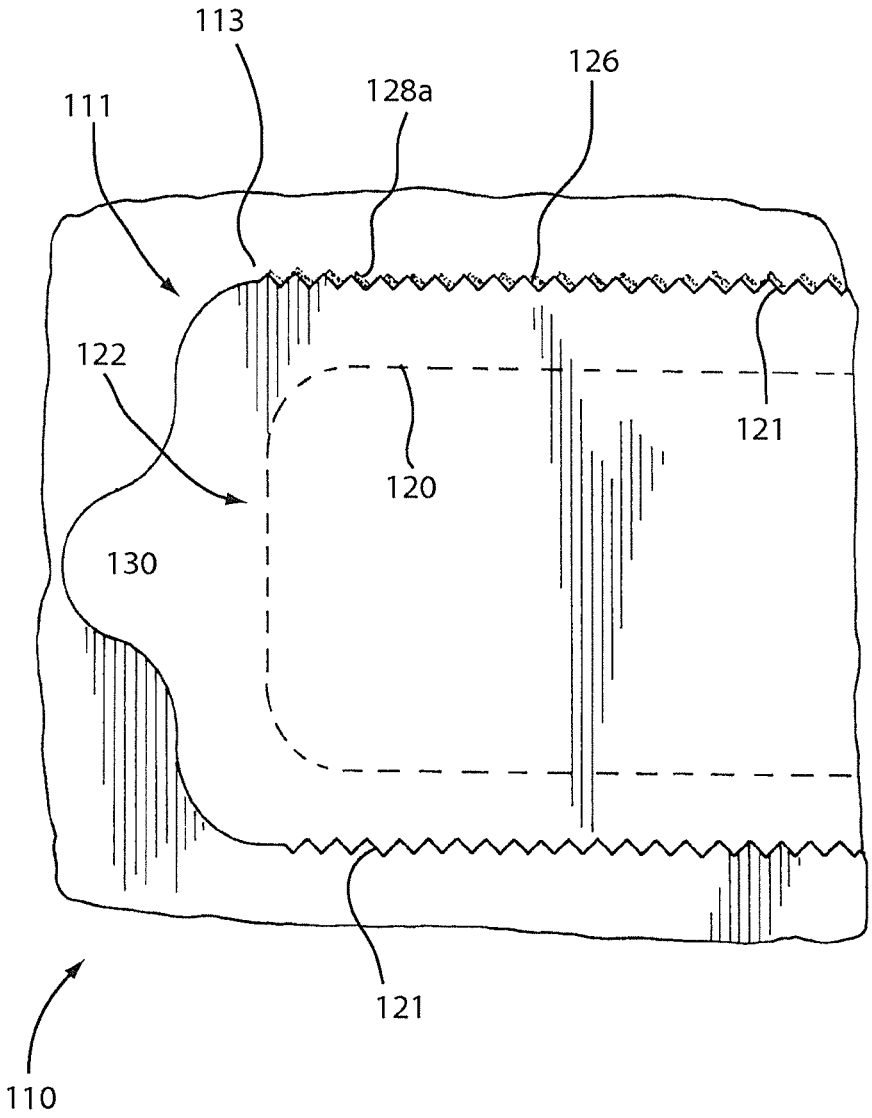
FIG. 2C is an enlarged partial plan view of a package, similar to the one of FIG. 1, with an alternative sealing panel, in accordance with the present invention.
Figure 3:
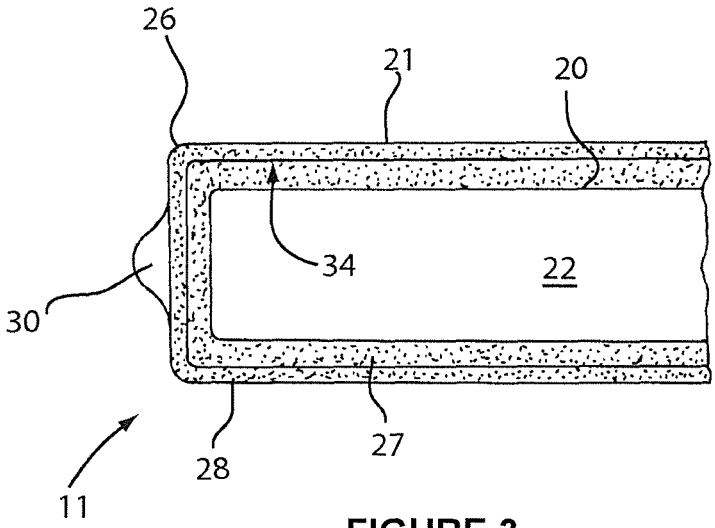
FIG. 3 is a partial plan view of a sealing panel with attached film layer flap of the package of FIG. 1, as viewed from below, in its initial condition.
Figure 4:
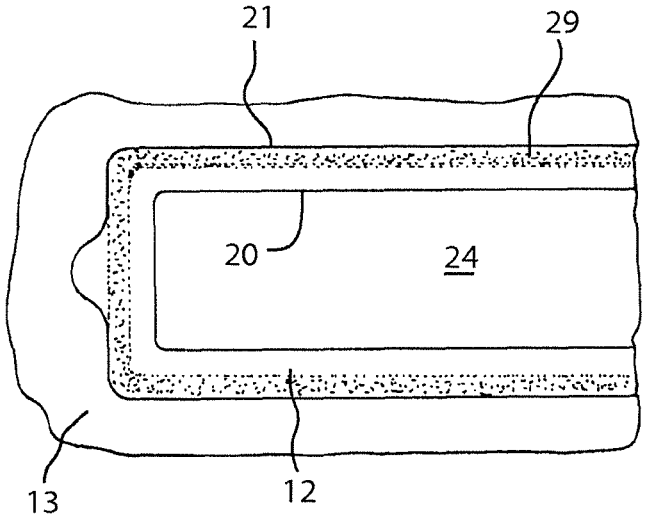
FIG. 4 is a partial plan view of the top of the package of FIG. 1, with the sealing panel not shown, prior to the package being opened.

An alternative embodiment to package 10 is depicted in FIG. 2C where like elements are raised by 100. Package 110 is shown as a partial plan view and is identical to package 10, except the tear line in the outer film layer 121 has a zigzag pattern rather than the linear tear line 21 of package 10. All other features of closure 111 are identical to those of closure 11. Following an initial opening and resealing of closure 111, the transfer coating 128*a* will appear as a misaligned zigzag pattern with the pattern of second tear line 121, thus indicating that the closure 111 has been previously opened.

Referring now to FIGS. 7-12, in an alternative embodiment where like elements to the package 10 have been increased by 200, package 210 includes closure 211, a film layer 214 forming the top sides and crimped ends 218, 219. The film layer 214 is die cut along tear line 220. A sealing panel 226 is adhesively sealed to the top surface of package 210.

Figure 9:
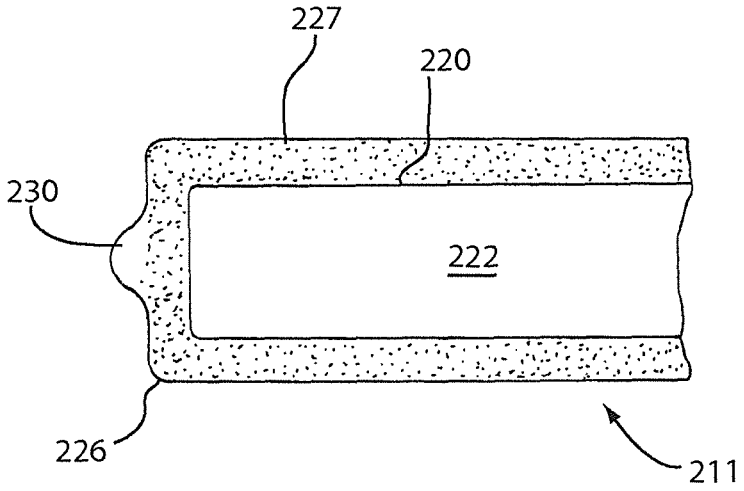
FIG. 9 is a partial plan view of a sealing panel with attached film layer flap of the package of FIG. 7, as viewed from below, in its initial condition.
Figure 10:
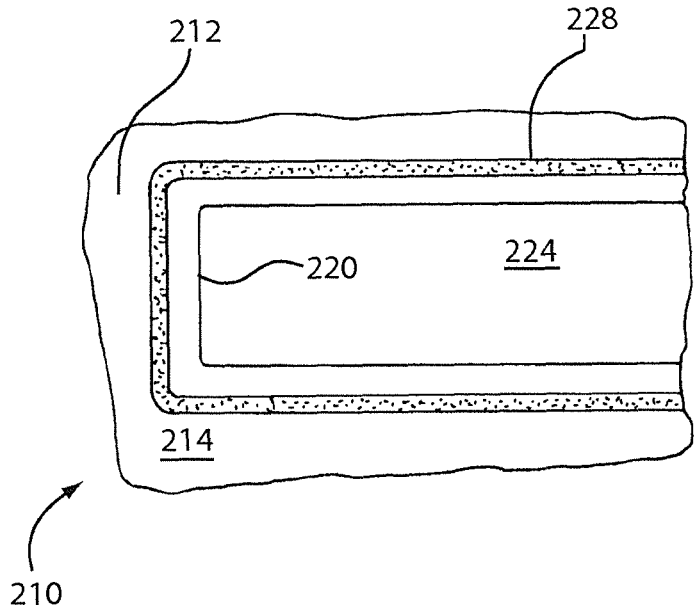
FIG. 10 is a partial plan view of the top of the package of FIG. 7, with the sealing panel not shown, prior to the package being opened.
Figure 11:
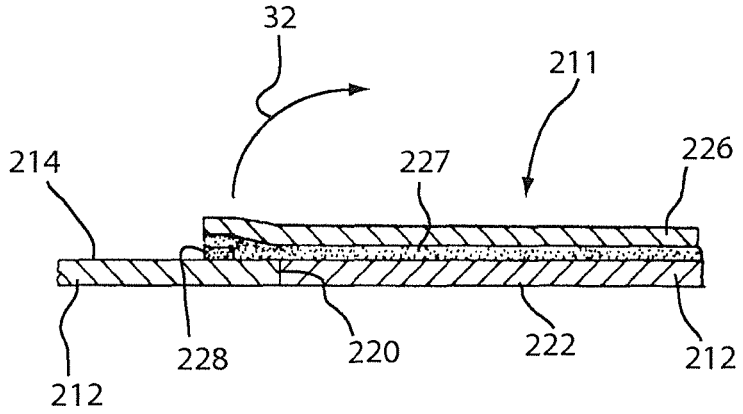
FIG. 11 is a partial enlarged cross-sectional view of the closure of FIG. 7, taken along line 11-11 of FIG. 7.

Referring now specifically to FIGS. 9 and 10, FIG. 9 shows the sealing panel 226 with flap 222 and FIG. 10 shows the top of package 210 with the sealing panel not shown for simplification to illustrate the various layers and surfaces prior to an initial opening of the closure 211. A coating of transferable material 228 is initially disposed around the perimeter of opening 224 on film layer 212, in a similar manner as coating 28 is applied to package 10. Advantageously, the coating 228 is applied to portions of the film layer 212 that will be in direct contact with a releasable adhesive 227 of the sealing panel 226 when the sealing panel is placed over top 214 of package 210. Advantageously, the coating 228 has a weaker bonding strength to the film layer 212 than the bond strength of the coating 228 to the releasable adhesive 227.

Figure 8A:
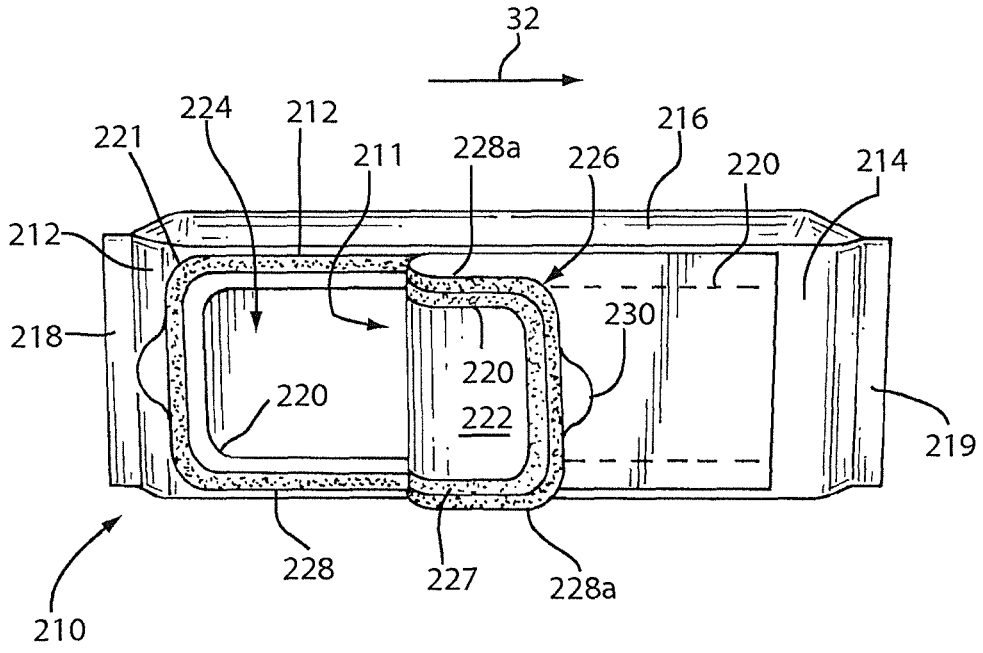
FIG. 8A is the package of FIG. 7, shown in a partially opened condition.
Figure 8B:
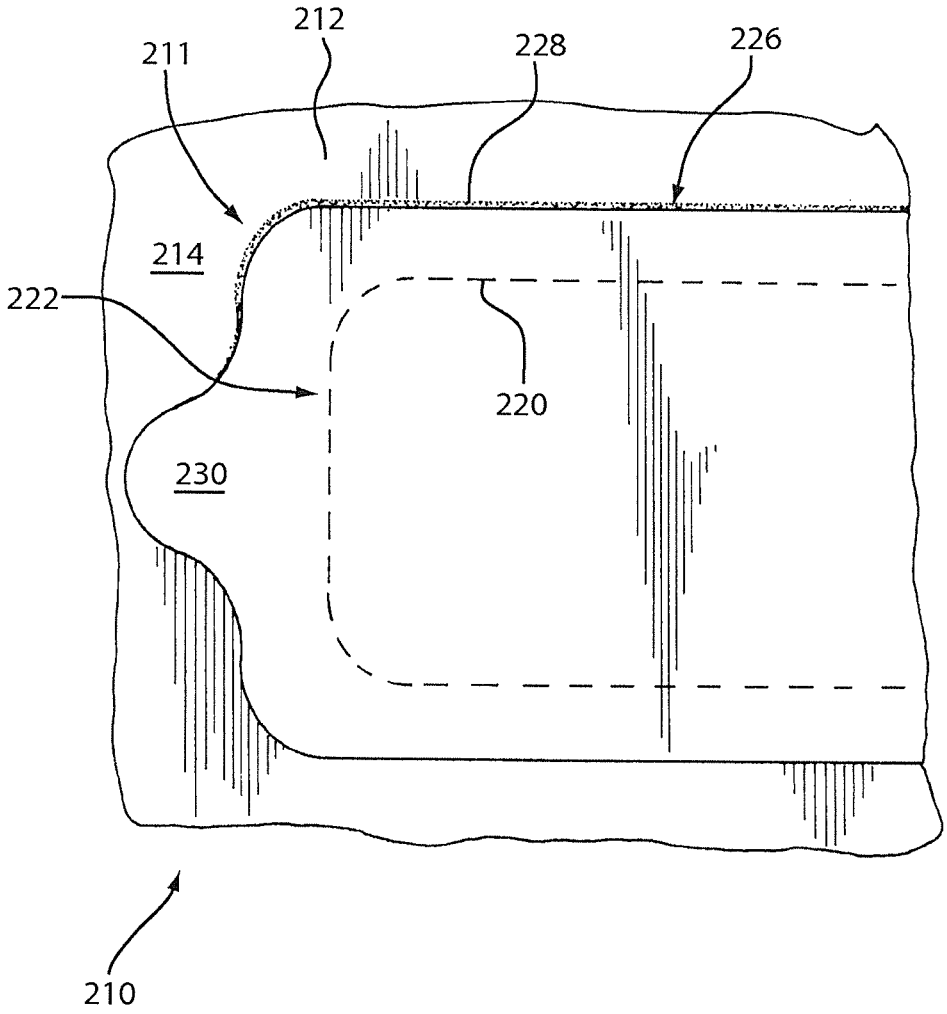
FIG. 8B is a partial enlargement of the package of FIG. 7, after the package has been opened and subsequently closed.
Figure 12:
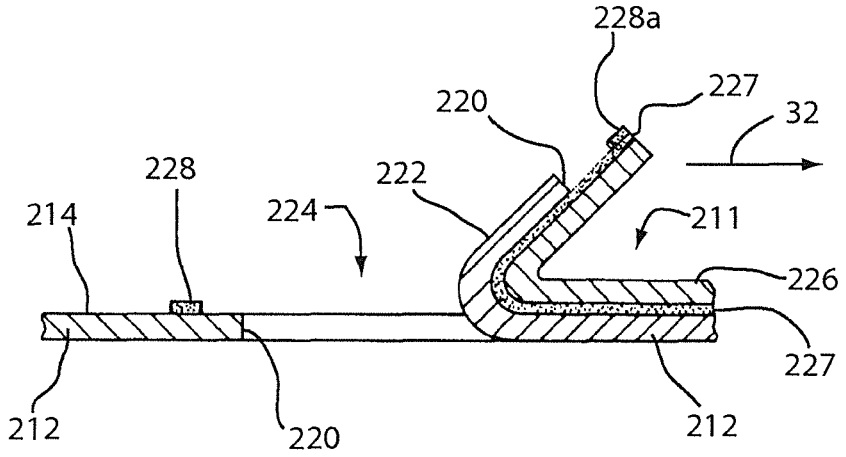
FIG. 12 is a partial enlarged cross-sectional view of the closure, similar to FIG. 11, depicting a resealed configuration of the closure after the initial opening.
Figure 13:
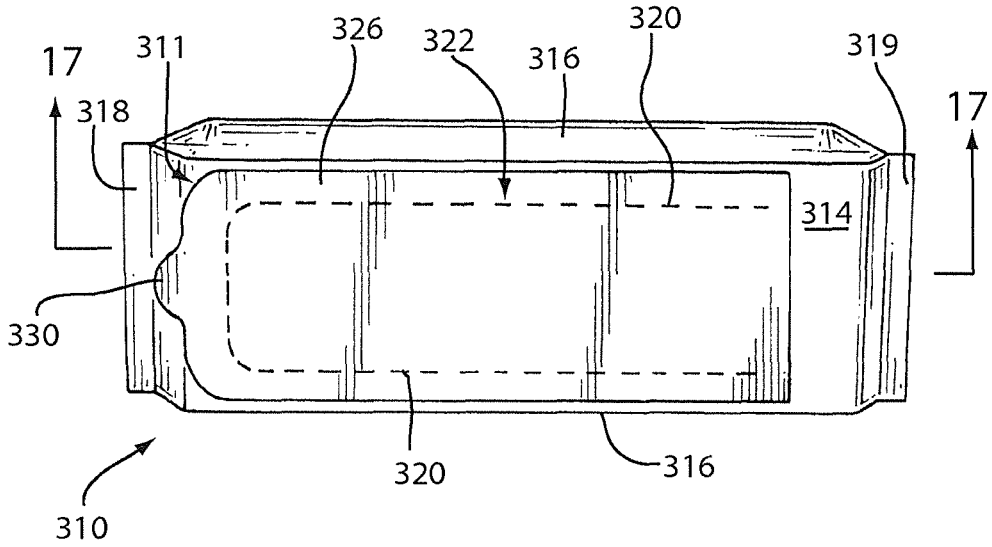
FIG. 13 is a perspective view of another package including an exemplary closure prior to an initial opening, in accordance with another aspect of the present invention.

When the sealing panel 226 is pulled back for a first time, some or all of the coating 228, for example, transferred coating portion 228*a*, will be transferred from the film layer 212 to the releasable adhesive 227, thus deadening those portions of the adhesive 227 now covered with transferred coating 228*a*, as shown in FIGS. 8*a* and 12. The transfer of the coating 228 to the sealing panel 226 provides a visual indicia to alert customers that the sealing panel 226 has already been peeled back, thus providing indicia of package integrity, as shown in FIG. 8A. In addition, package integrity is provided by a reduction in peel force between the sealing panel 226 and the film layer 212 due to the deadened areas of the adhesive 227 where the coating 228*a* has now been transferred after the package 210 has been previously opened. It should be noted that the coating 228 can be deposited partially or totally around the perimeter of the access opening 224. In addition, further visual indicia is provided by viewing a portion of coating 228 observable when viewing the top 214 of package 210 due to slight misalignment of the sealing panel 226, as shown in FIG. 8B.

Figure 14A:
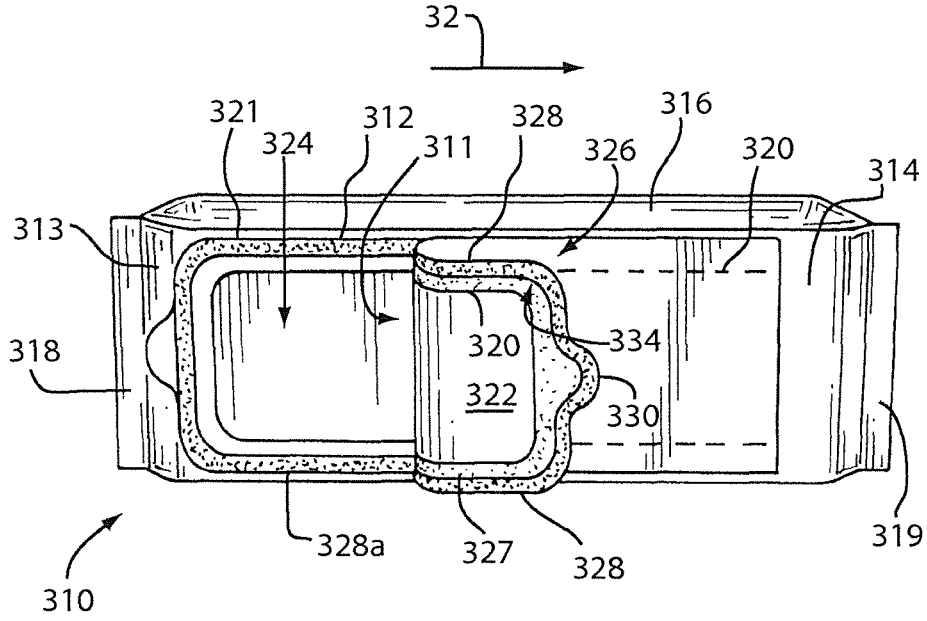
FIG. 14A is the package of FIG. 13, shown in a partially opened condition.
Figure 14B:
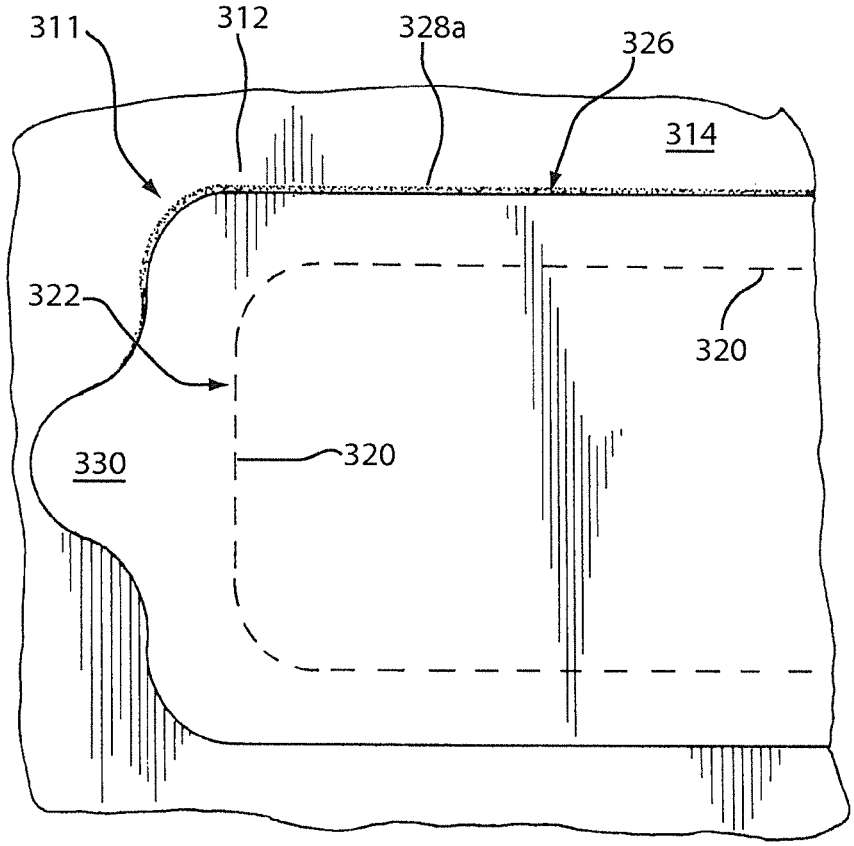
FIG. 14B is a partial enlargement of the package of FIG. 13, after the package has been opened and subsequently closed.
Figure 15:
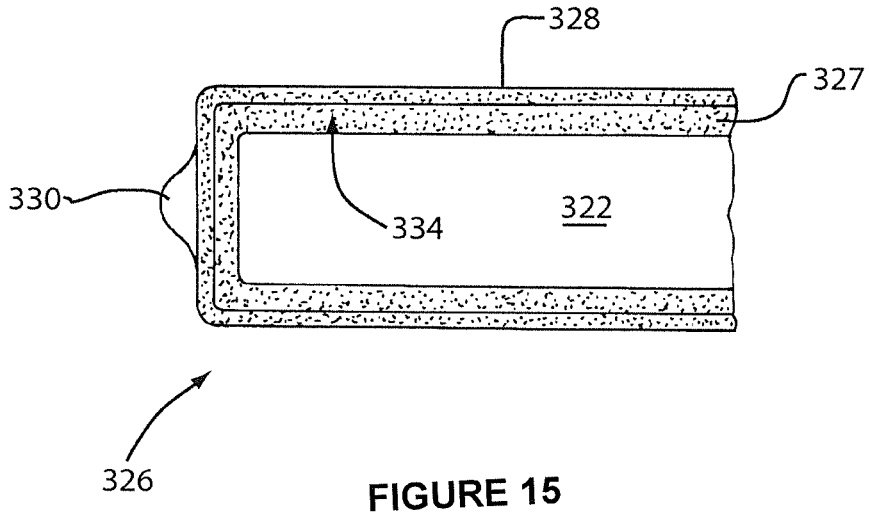
FIG. 15 is a partial plan view of a sealing panel with attached film layer flap of the package of FIG. 13, as viewed from below, in its initial condition.
Figure 16:
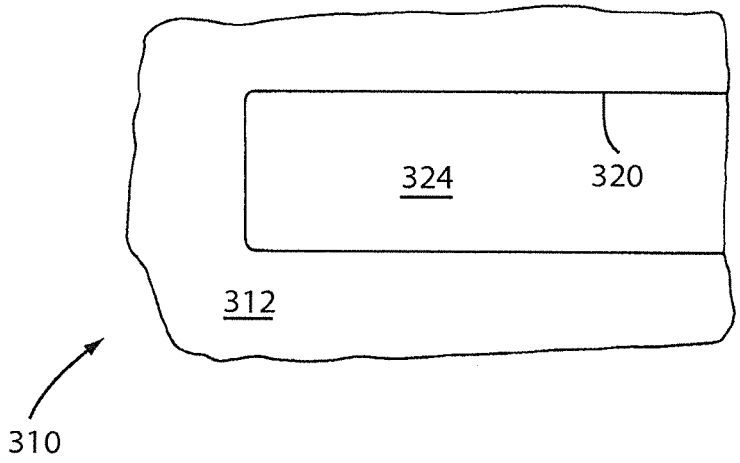
FIG. 16 is a partial plan view of the top of the package of FIG. 13, with the sealing panel not shown, prior to the package being opened.
Figure 17:
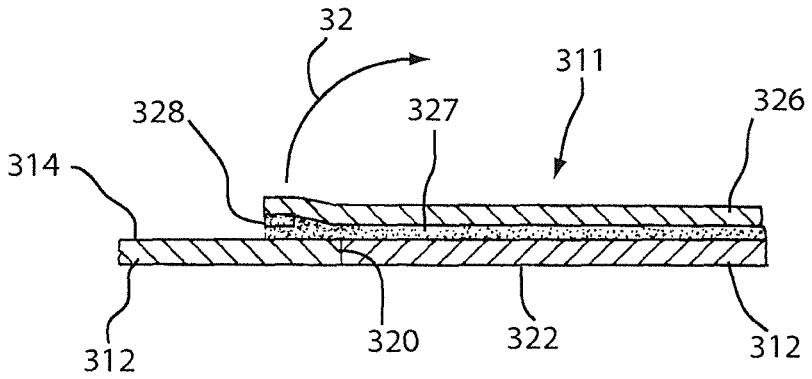
FIG. 17 is a partial enlarged cross-sectional view of the closure of FIG. 13, taken along line 17-17 of FIG. 13.
Figure 18:
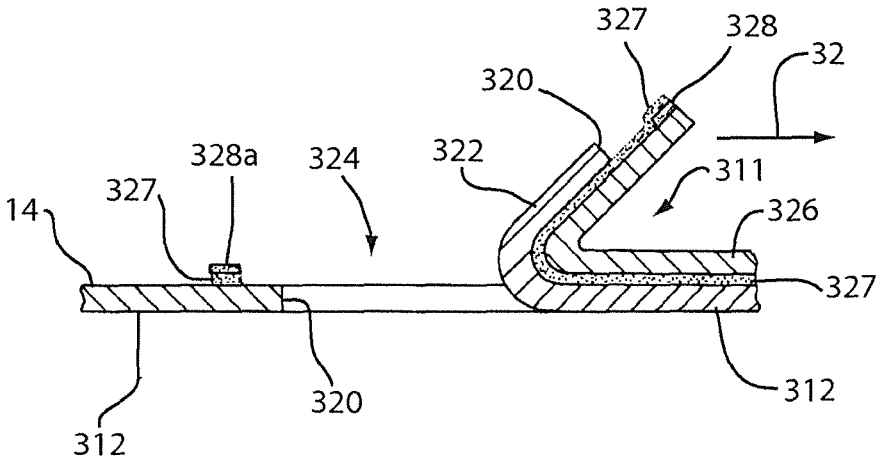
FIG. 18 is a partial enlarged cross-sectional view of the closure similar to FIG. 17 depicting an initial opening of the closure.

An additional alternative embodiment of a package with a package integrity feature, in accordance with the present invention, is provided in FIGS. 13-18, where like elements to those of package 10 are increased by 300. Package 310 is identical to package 210, except that rather than a coating of transferable material being initially applied to the film layer 214, a coating of transferable material 328 is first applied to the perimeter edge 334 of the sealing panel 326 prior to applying a releasable adhesive 327, as shown in FIGS. 15 and 17. Advantageously, the coating 328 can be applied to the back surface of sealing panel 326 using reverse printing. Advantageously, portions of the print layer of coating 328 are specially treated so as to weaken a bonding strength between the coating 328 and the label face stock of the sealing panel 326.

When the package 310 is opened for a first time, a portion of the adhesive 327 bonded to the coating 328 will be transferred from the sealing label 325 to the film layer 312 to form transferred coating 328*a* to the top of the package 310. (See FIGS. 15-18.) As a result, the transfer coating 328*a* creates a visual indicia on the top 314 of the package 310, which is visible due to slight misalignment of the sealing panel 326 with the film layer 312 when the sealing panel 326 is returned to its flat position, as shown in FIG. 14B. In addition, there will be a reduction in peel force between the sealing panel 326 and the film layer 312 after the package 310 has been opened and resealed for a first time due to portions of the sealing panel 326 missing portions of the adhesive 327, which is now transferred to the top 314 of the film layer 312 with coating 328*a*.

While FIGS. 1-18 show and describe closures 11, 111, 211 and 311 as forming the opening of a wrapper which defines packages 10, 110, 210 and 310, the closure may form a top of other packages having resealable openings, such as those described in U.S. patent application Ser. No. 11/193,613, herein incorporated by reference and, thus, the closure can form a closure over a thermoform tray having a sealing panel or layer as a lidding material over the top of the tray.

Figure 19:
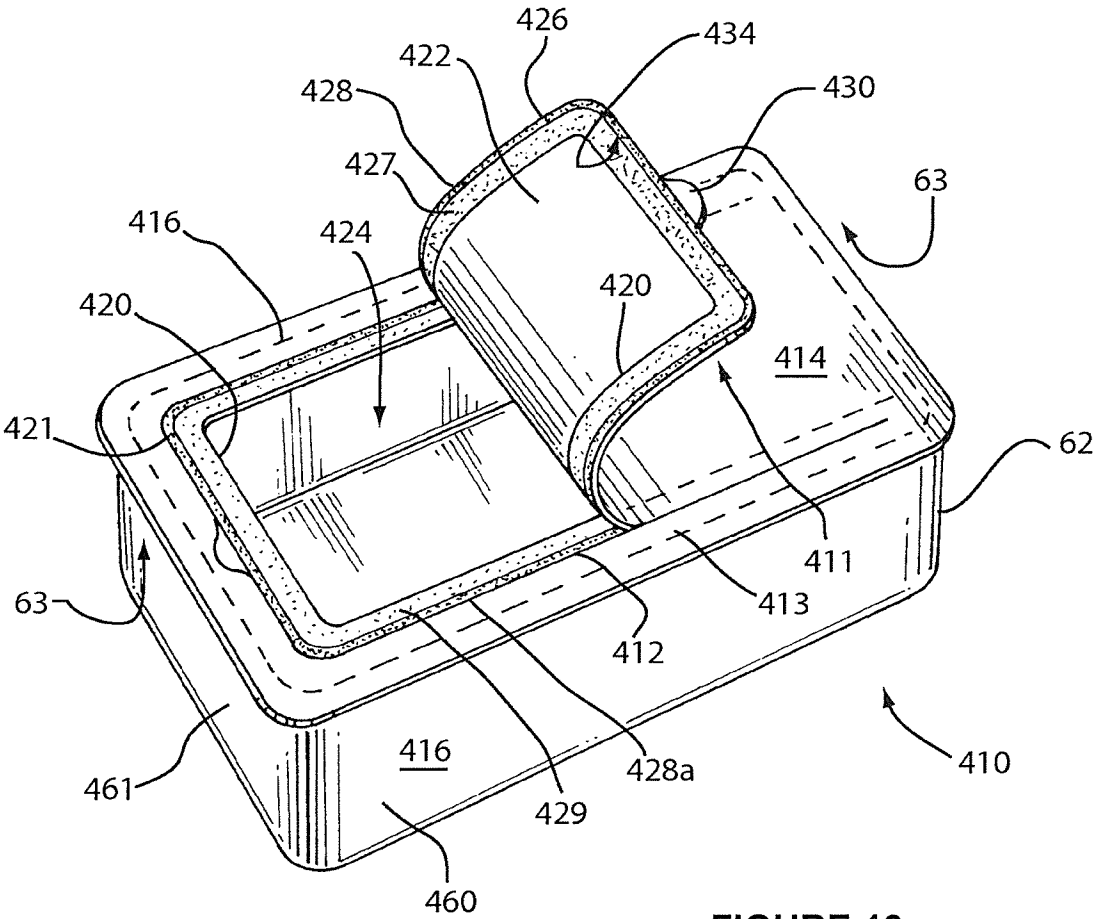
FIG. 19 is a perspective view of another package, including a closure that has been opened, in accordance with the present invention.

Referring to FIG. 19, where like elements to those of the embodiments of FIGS. 1-6 are increased by 400, package 410 comprises a thermoform tray 460 which forms sides 416 and ends 461, 462. A two-ply film material comprising an inner film layer 412 and outer film layer 413 are sealed to flange 463 of the thermoform tray 460. Like packages 10, 110, 210, 310, pulling back tab 430 separates the sealing panel 426 from the outer film layer 413 and separates the panel 422 from the inner film layer 412.

As with package 10, package 410 has a coating of transferable material 428 deposited on the perimeter 434 of the sealing label 426 and adhesive 427 formed around the perimeter of the inner film layer 412 adjacent the second tear line 421, which lies directly underneath the coating 428 when the sealing panel is laid flat on the top 414 of the package 410. Like package 10, peeling back the sealing panel 426 for a first time transfers a portion of the coating 428 to adhesive 429. When the sealing panel 426 is returned to its flat position, a portion of the transferred coating 428*a* will be visible when viewing the top of the package 410, due to a slight misalignment of the sealing panel 426 with the inner layer 412, in a similar manner as with package 10.

Although package 410 is described as having closure 411, package 410 can incorporate any of the closures 11, 111, 211 and 311. It will now be evident to one of ordinary skill in the art that the present resealable package with package integrity features provides advantages not found in prior packages.

Although the invention has been described above in relation to preferred embodiments thereof, it will be understood by those skilled in the art that variations and modifications can be effected in these preferred embodiments without departing from the scope and spirit of the invention.

We claim:

1. A package comprising:

a wrapper forming a top, sides, and a bottom of the package;

a top portion of the package having a multi-layer material with first and second layers;

a closure formed by a first cut of the first layer defining a flap and a second cut formed in the second layer defining a sealing panel, wherein a margin of the sealing panel extends beyond the flap, the closure being movable to expose an access opening and a sealing area of the first layer includes the portion of the first layer that faces the margin of the sealing panel;

a first portion of the margin facing the first layer or the sealing area having a first adhesive and providing the package with resealing capabilities;

a second portion of the margin or the sealing area having a coating of transferable material disposed thereon, the transferable material having a deadening effect on the first adhesive;

wherein the transferable material is disposed on the margin or the sealing area such that the transferable material does not interrupt the first adhesive as the first adhesive extends continuously along the access opening;

wherein upon initial opening of the package, the coating of transferable material, which has a sufficiently strong bond with the first layer, is transferred from one of the margin or the sealing area to the other thereof and wherein the transferred coating of transferable material is visible beyond the sealing panel when the package is reclosed to provide a visual tamper evident feature.

2. The package of claim 1 wherein the first and second layers are coextensively formed and adhered to one another.

3. The package of claim 2 wherein the first cut of the first layer is a continuously formed cut such that the flap is completely separable from a remainder of the first layer to expose the access opening.

4. The package of claim 1 wherein the second film layer is a label and the second cut of the second layer is defined by a perimeter of the label.

5. The package of claim 1 wherein the coating of transferable material is a different color than an adjacent portion of the remainder of the wrapper.

6. The package of claim 1 wherein the coating of transferable material is a different pattern than an adjacent portion of the remainder of the wrapper.

7. The package of claim 1 wherein the first and second portions of the margin or the sealing area overlap with one another.

8. The package of claim 1 wherein at least a portion of the first and second portions of the margin or the sealing area are distinct from one another such that the first and second portions do not entirely overlap one another.

9. The package of claim 1 wherein the first adhesive completely covers the margin facing the first layer except for the gripping tab or the sealing area facing the margin.

10. The package of claim 9 further comprising a second adhesive disposed on an outer portion of the margin facing the first layer or the sealing area such that the second adhesive covers less area than the first adhesive.

11. The package of claim 10 wherein the first adhesive permits resealing of the closure with the wrapper and the second adhesive permits the transfer of the coating of transferable material by providing the coating of transferable material with a sufficiently strong bond with the first layer.

12. The package of claim 10 wherein the second adhesive is disposed on the outer portion of the margin or sealing area such that the first adhesive is disposed on an inner portion, around the entire sealing area adjacent the access opening.

13. The package of claim 12 wherein, after initial package opening, the second adhesive is deadened due to the transfer of the coating of transferable material thereby providing a tactile tamper evident feature.

14. The package of claim 9 wherein the first adhesive is a resealable adhesive and at least a portion of the resealable adhesive transfers from the margin of the sealing panel to the first layer.

15. The package of claim 1 wherein the second cut is in the form of a non-linear line segment.

16. The package of claim 1 wherein the package comprises a food container with a tray wherein the access opening provides access to food within the tray.

17. The package of claim 1 further comprising a tray within the wrapper.

18. The package of claim 17 further comprising discrete food articles disposed within the tray contained in the wrapper.

19. A package comprising:

a wrapper forming a top, sides, and bottom of the package;

a top portion of the package having a multi-layer material with first and second layers;

a closure formed by a first cut of the first layer defining a flap and a second cut formed in the second layer defining a sealing panel, wherein a margin of the sealing panel extends beyond the flap, the closure being movable to expose an access opening and a sealing area of the first layer includes the portion of the first layer that faces the margin of the sealing panel;

a first adhesive providing the package with resealing capabilities, the first adhesive disposed on the sealing panel;

a second adhesive disposed on the sealing area of the first layer;

a coating of transferable material disposed on the sealing panel prior to initial package opening and, upon initial opening of the package, the transferable material transferring from the sealing panel to the first layer due to a sufficient bond with the second adhesive disposed on the first layer;

wherein the transferable material is disposed on a perimeter edge of the margin such that the transferable material does not interrupt the first adhesive extending continuously along the access opening;

and wherein the transferred coating of transferable material is visible beyond the sealing panel when the package is reclosed to provide a visual tamper evident feature and the transferable material has a deadening effect on at least a portion of the second adhesive disposed on the first layer where the transferred coating has been transferred.

20. The package of claim 1 wherein the first adhesive is disposed only along a perimeter edge of the margin of the sealing panel.

* * * * *